US007717073B2

(12) United States Patent
Koshimizu et al.

(10) Patent No.: US 7,717,073 B2
(45) Date of Patent: May 18, 2010

(54) COLLAR AND VARIABLE VALVE ACTUATION MECHANISM

(75) Inventors: Takahide Koshimizu, Toyota (JP); Fuminori Hosoda, Toyota (JP); Koichi Shimizu, Toyota (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 66 days.

(21) Appl. No.: 11/125,353

(22) Filed: May 10, 2005

(65) Prior Publication Data

US 2005/0247278 A1 Nov. 10, 2005

(30) Foreign Application Priority Data

May 10, 2004 (JP) ..... 2004-140022

(51) Int. Cl.
*F01L 1/34* (2006.01)

(52) U.S. Cl. ..... 123/90.16; 123/90.15

(58) Field of Classification Search ..... 123/90.16, 123/90.15, 90.31, 90.18
See application file for complete search history.

(56) References Cited

U.S. PATENT DOCUMENTS

| | | | | |
|---|---|---|---|---|
| 5,231,959 | A * | 8/1993 | Smietana | 123/90.12 |
| 5,307,768 | A * | 5/1994 | Beier et al. | 123/90.17 |
| 5,636,603 | A | 6/1997 | Nakamura et al. | |
| 5,664,463 | A | 9/1997 | Amborn et al. | |
| 5,979,384 | A | 11/1999 | Oka et al. | |
| 6,425,357 | B2 | 7/2002 | Shimizu et al. | |
| 2001/0023674 | A1 * | 9/2001 | Shimizu et al. | 123/90.18 |

FOREIGN PATENT DOCUMENTS

| | | |
|---|---|---|
| DE | 44 16 505 A1 | 11/1995 |
| GB | 2 247 061 A | 2/1992 |
| JP | 01224407 | 7/1989 |
| JP | 5-78904 | 10/1993 |
| JP | 10-196321 | 7/1998 |
| JP | 2000-034909 | 2/2000 |
| JP | 2001-263015 | 9/2001 |
| JP | 2004-340140 | 12/2004 |

OTHER PUBLICATIONS

Corresponding European Search Report dated Jul. 27, 2005.
Japanese Language Version of Japanese Office Action, Appln. No. 2004-140022 dated Nov. 20, 2007.
Chinese Language Version of Chinese Office Action, Appln. No. 200510069071.8, issued Jul. 6, 2007.
English Translation of Chinese Office Action, Appln. No. 200510069071.8, issued Jul. 6, 2007.

* cited by examiner

*Primary Examiner*—Zelalem Eshete
(74) *Attorney, Agent, or Firm*—Kenyon & Kenyon LLP

(57) ABSTRACT

An engine variable valve actuation mechanism that substantially equally adjusts the valve lift amount in each cylinder. The mechanism includes variable valve lift mechanisms respectively arranged in association with the engine cylinders. A control shaft extends through the variable valve lift mechanisms. An actuator moves the control shaft in the axial direction and drives the variable valve lift mechanisms. Collars are arranged alternately with the variable valve lift mechanisms. Each collar includes a cylindrical sleeve and flanges formed integrally with the sleeve. The flanges directly or indirectly contact the end faces of adjacent variable valve lift mechanisms. This determines the positions of the variable valve lift mechanisms with respect to one another in the axial direction.

15 Claims, 24 Drawing Sheets

COLLAR AND VARIABLE VALVE ACTUATION MECHANISM

CROSS-REFERENCE TO RELATED APPLICATIONS

This application is based upon and claims the benefit of priority from prior Japanese Patent Application No. 2004-140022, filed on May 10, 2004, the entire contents of which are incorporated herein by reference.

BACKGROUND OF THE INVENTION

The present invention relates to a collar for receiving a shaft for a variable valve lift mechanism in a multiple-cylinder internal combustion engine.

Japanese Laid-Open Patent Publication No. 2001-263015 describes a variable valve actuation mechanism for an internal combustion engine. The variable valve actuation mechanism includes a variable valve lift mechanism, which is arranged for each cylinder to adjust the lift amount of intake and exhaust valves. A support pipe (rocker shaft) extends through the center of the variable valve lift mechanism. A control shaft is arranged in the support pipe. The variable valve lift mechanism is pivoted in a state supported by the support pipe. The lift amount of the valve is adjusted by moving the control shaft in the axial direction.

The support pipes are supported by a plurality of supports arranged on a cylinder head between the variable valve lift mechanisms. The supports position the variable valve lift mechanisms in the axial direction. The valve lift mechanisms are positioned in the axial direction with high accuracy so that the movement of the control shaft adjusts the valve lift amount to be the same in every cylinder.

In an internal combustion engine, the cylinder block, cylinder head, and cam carrier are formed from a light alloy or a light metal, such as aluminum, to reduce weight. However, shafts included in the variable valve actuation mechanism, such as the control shaft, are not formed from a light alloy or a light metal and formed from a steel material, such as cast steel or cast iron, to meet the high strength requirements.

The coefficient of thermal expansion differs greatly between light alloy and steel. Thus, when comparing a state in which the engine is cool and a state in which the engine is warm, the control shaft becomes shorter and changes the interval between the supports located closer to the cylinder head and cam carrier. This produces a difference in the relative positions of the control shaft and the variable valve lift mechanism between cylinders close to the basal end of the control shaft and cylinders close to the distal end of the control shaft. Accordingly, the lift amount differs between cylinders. Such difference causes difficulties for adjusting the combustion state of each cylinder with high accuracy. This may generate vibrations or deteriorate emission and cause an undesirable engine operation state.

The rocker shaft, which supports the variable valve lift mechanism, is arranged at the outer side of the control shaft. When the rocker shaft, which receives the control shaft, has a large diameter, the variable valve lift mechanism that receives the rocker shaft is enlarged. This enlarges and increases the weight of the variable valve actuation mechanism, which would contradict the demand for a smaller and lighter internal combustion engine.

SUMMARY OF THE INVENTION

It is an object of the present invention to provide a variable valve actuation mechanism that substantially equally adjusts the valve lift amount in each cylinder. Another object of the present invention is to provide a compact and light variable valve actuation mechanism. A further aspect of the present invention is to provide a collar for such a variable valve actuation mechanism.

One aspect of the present invention is a collar for receiving a shaft of a multiple cylinder engine. The shaft supports a plurality of variable valve lift mechanisms respectively arranged in correspondence with a plurality of cylinders. Each variable valve lift mechanism has an end face, and the engine includes a plurality of supports for supporting the shaft. The collar includes a sleeve extending in an axial direction and end portions formed integrally with the sleeve. In use, a plurality of said collars are fastened to the shaft, with the sleeve of each collar being arranged between the shaft and a corresponding one of the supports so that at least one of the end portions directly or indirectly contacts or engages the end face of one of the variable valve lift mechanisms to determine the positions of the variable valve lift mechanisms.

Another aspect of the present invention is a variable valve actuation mechanism for use in a multiple cylinder engine. The variable valve actuation mechanism includes a plurality of variable valve lift mechanisms respectively arranged in association with the cylinders of the engine. Each variable valve lift mechanism includes an end face. A control shaft extends through the variable valve lift mechanisms in an axial direction. An actuator moves the control shaft in the axial direction and drives the variable valve lift mechanisms. A plurality of collars are arranged alternately with the variable valve lift mechanisms for determining the positions of the variable valve lift mechanisms with respect to one another in the axial direction. Each collar includes a sleeve extending in the axial direction and end portions formed integrally with the sleeve. At least one of the end portions directly or indirectly contacts the end face of one of the variable valve lift mechanisms.

A further aspect of the present invention is a variable valve actuation mechanism for use in a multiple cylinder engine. The variable valve actuation mechanism includes a plurality of variable valve lift mechanisms respectively arranged in association with the cylinders of the engine. Each variable valve lift mechanism includes an end face. A control shaft extends through the variable valve lift mechanisms in an axial direction. An actuator moves the control shaft in the axial direction and drives the variable valve lift mechanisms. A plurality of collars are arranged alternately with the variable valve lift mechanisms for determining the positions of the variable valve lift mechanisms with respect to one another in the axial direction. Each collar includes a sleeve extending in the axial direction and end portions formed integrally with the sleeve. At least one of the end portions engages the end face of an adjacent one of the variable valve lift mechanisms and includes a shaft projection functioning as part of a pivot shaft of the variable valve lift mechanisms.

Another aspect of the present invention is a variable valve actuation mechanism for use in a multiple cylinder engine. The variable valve actuation mechanism includes a plurality of variable valve lift mechanisms respectively arranged in association with the cylinders of the engine. Each variable valve lift mechanism includes an end face. A control shaft extends through the variable valve lift mechanisms in an axial direction. An actuator moves the control shaft in the axial direction and drives the variable valve lift mechanisms. A plurality of collars are arranged alternately with the variable valve lift mechanisms for determining the positions of the variable valve lift mechanisms with respect to one another in the axial direction. Each collar includes a sleeve extending in the axial direction and end portions formed integrally with the sleeve. At least one of the end portions directly or indirectly contacts the end face of an adjacent one of the variable valve lift mechanisms to determine the positional relationship between the variable valve lift mechanisms in the axial direction, and includes a shaft projection for engaging the end face of the one of the variable valve lift mechanisms to function as part of a pivot shaft of the variable valve lift mechanism.

A further aspect of the present invention is a variable valve actuation mechanism for use in a multiple cylinder engine. The variable valve actuation mechanism includes a plurality of variable valve lift mechanisms respectively arranged in association with the cylinders of the engine. Each variable valve lift mechanism has an end face. A control shaft extends through the variable valve lift mechanisms in an axial direction. A hollow shaft receives the control shaft. The hollow shaft is formed from a metal material having a first coefficient of thermal expansion. An actuator moves the control shaft in the axial direction and drives the variable valve lift mechanisms. A plurality of collars are fastened to the hollow shaft and arranged alternately with the variable valve lift mechanisms for determining the positions of the variable valve lift mechanisms with respect to one another in the axial direction. A plurality of supports respectively support the collars. Each collar includes a sleeve extending in the axial direction and end portions formed integrally with the sleeve. The sleeve and the at least one end portion is formed from a material having a coefficient of thermal expansion that is equal to or approximate to the first coefficient of thermal expansion. Each collar is supported by the corresponding support such that a clearance is formed between the end face of an adjacent one of the variable valve lift mechanisms and the corresponding support. The contact shaft and the support holding the collar such as to restrict the sleeve from becoming eccentric while enabling movement of the collar in the axial direction.

Another aspect of the present invention is a variable valve actuation mechanism for use in a multiple cylinder engine. The variable valve actuation mechanism includes a plurality of variable valve lift mechanisms respectively arranged in association with the cylinders of the engine. Each variable valve lift mechanism has an end face. A control shaft extends in an axial direction. The variable valve lift mechanisms are fastened to a hollow shaft, which receives the control shaft. An actuator moves the control shaft in the axial direction and drives the variable valve lift mechanisms. A plurality of supports support the variable valve lift mechanisms via the hollow shaft. The variable valve lift mechanisms are fastened to the hollow shaft in a state in which movement in the axial direction is restricted in order to determine the positions of the variable valve lift mechanisms with respect to one another in the axial direction.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

Figure 1:
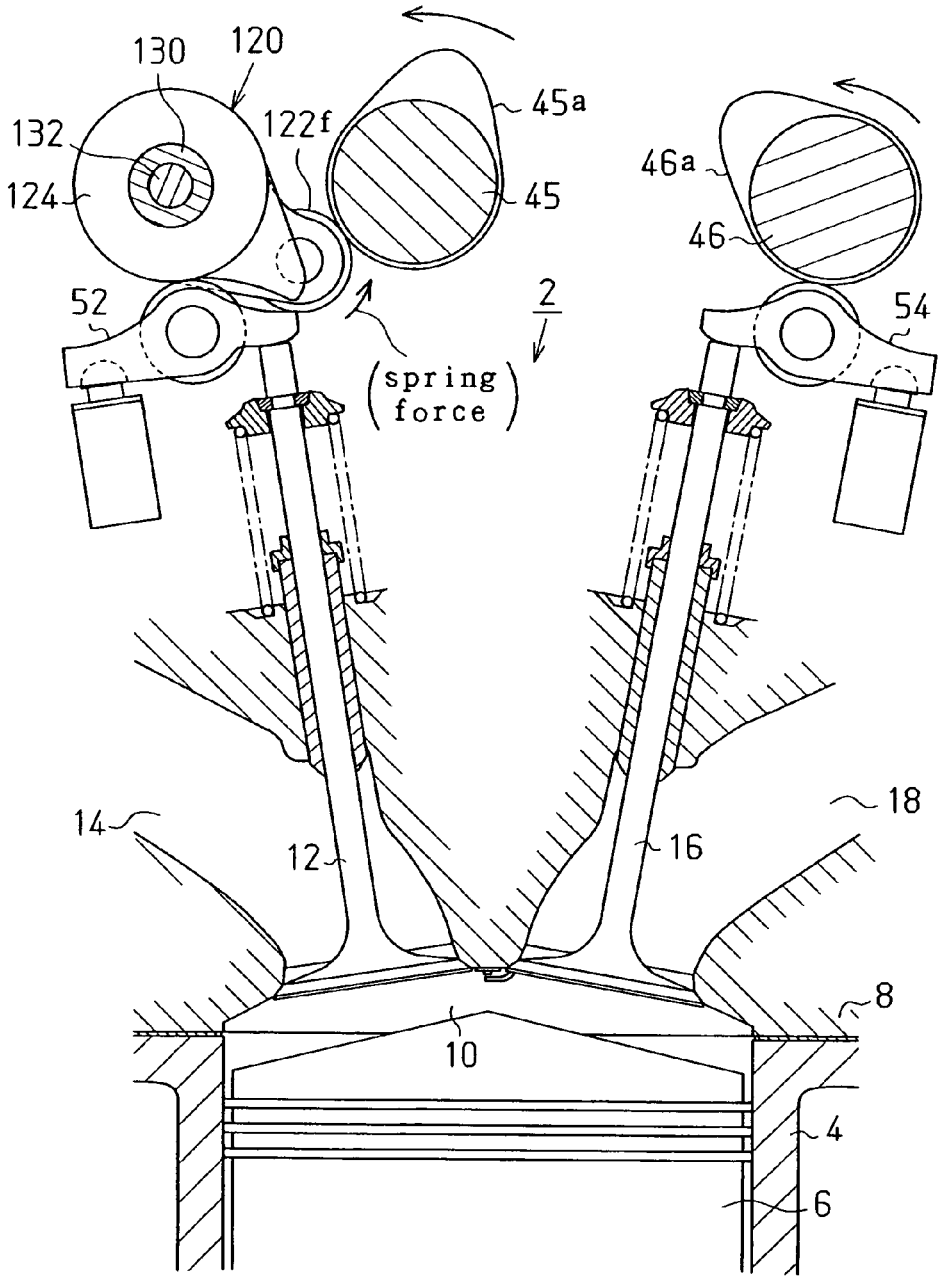
FIG. 1 is a cross-sectional diagram showing an engine and a variable valve actuation mechanism according to a first embodiment of the present invention.
Figure 2:
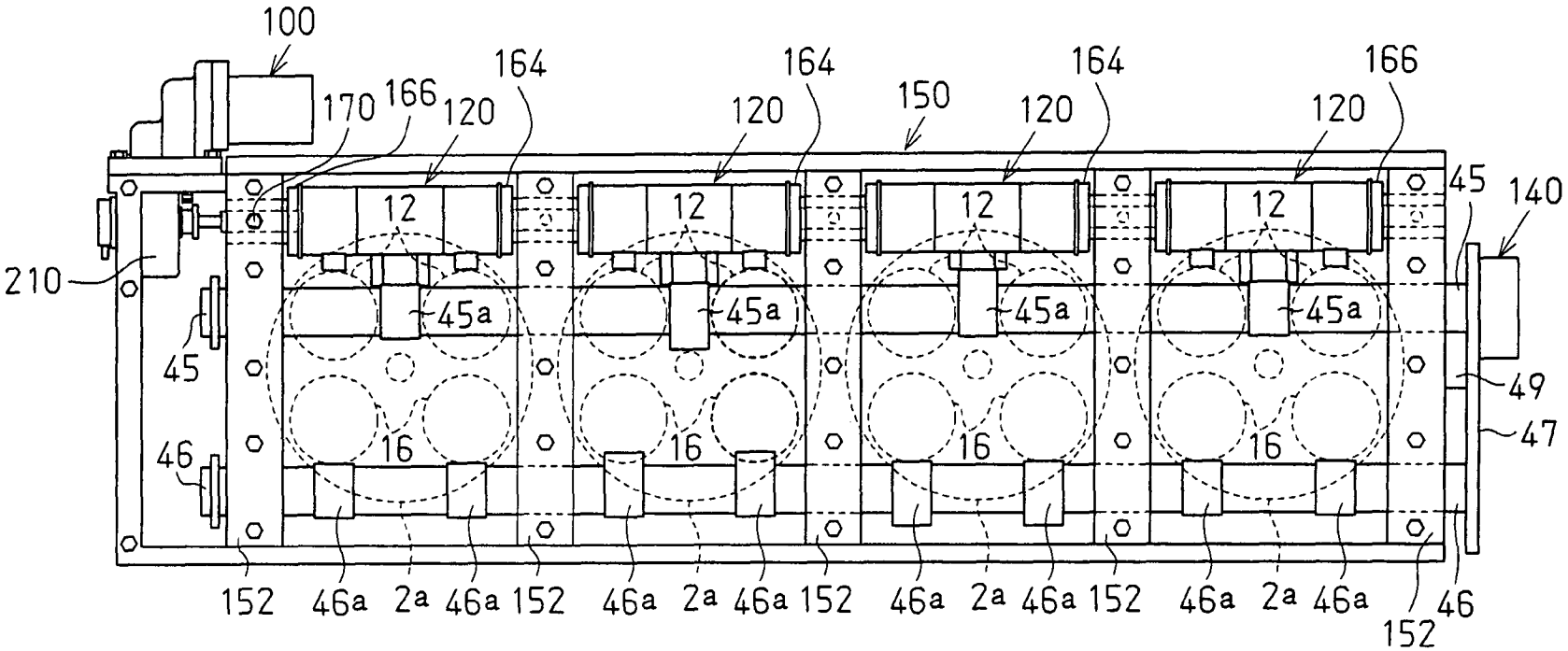
FIG. 2 is a plan view showing the engine of FIG. 1.

FIG. 1 is a schematic cross-sectional diagram showing a cylinder of a multiple-cylinder gasoline engine 2, which is installed in a vehicle. FIG. 2 is a plan view showing a cam carrier 150 arranged on the upper portion of the engine 2.

The engine 2 includes a cylinder block 4, pistons 6, and a cylinder head 8 mounted on the cylinder block 4. The cylinder block 4 and the cylinder head 8 are formed from an aluminum alloy material.

A plurality of (four) cylinders 2*a* are defined in the cylinder block 4. A combustion chamber 10 is defined in each cylinder 2*a* between the cylinder block 4, the corresponding piston 6, and the cylinder head 8. Two intake valves 12 and two exhaust valves 16 are arranged in each cylinder 2*a*. The intake valves 12 and the exhaust valves 16 respectively open and close associated intake ports 14 and exhaust ports 18.

Each intake port 14 is connected to a surge tank via an intake passage formed in an intake manifold. Each cylinder 2*a* is supplied with air from the surge tank. A fuel injector is arranged in each intake passage to inject fuel into the intake port 14 of the corresponding cylinder 2*a*. In this manner, fuel is supplied to a position upstream from the intake valve 12. Fuel may be directly supplied into each combustion chamber 10 as in an in-cylinder injection type gasoline engine.

The lift amount of the intake valve 12 is varied to adjust the intake air amount. The engine 2 of the first embodiment does not include a throttle valve that would be arranged in an intake passage upstream from the surge tank in a normal engine. However, the engine 2 of the first embodiment may include an auxiliary throttle valve. When an auxiliary throttle valve is employed, the auxiliary throttle valve is, for example, fully opened when the engine 2 is started and fully closed when the engine 2 is stopped. The open amount of the auxiliary throttle valve may be adjusted to control the intake air amount when lift amount adjustment of the intake valves 12 with valve lift mechanisms 120 is disabled.

Referring to FIG. 1, rotation of an intake camshaft 45 rotates an intake cam 45*a*. A variable valve lift mechanism 120 arranged on the cylinder head 8 converts the rotation of the intake cam 45*a* to a pivoting action of a roller rocker arm 52. Movement of the roller rocker arm 52 drives the intake valve 12. In this manner, the drive force of the intake camshaft 45 is transmitted to the intake valve 12.

Referring to FIG. 2, a slide actuator 100 adjusts the transmission state of the variable valve lift mechanisms 120 to adjust the lift amount of the intake valves 12.

A variable valve timing mechanism 140 is arranged at the front end of the intake camshaft 45. The intake camshaft 45 rotates in cooperation with the rotation of a crankshaft 49 of the engine 2 by means of a timing sprocket of the variable valve timing mechanism 140 and a timing chain 47.

An exhaust camshaft 46 is rotated in cooperation with rotation produced by the engine 2. Exhaust cams 46*a* arranged on the exhaust camshaft 46 open and close corresponding exhaust valves 16 with a constant lift amount by means of roller rocker arms 54. Each exhaust port 18 is connected to an exhaust manifold. Exhaust passes through a purification catalyst converter before being discharged.

Figure 3:
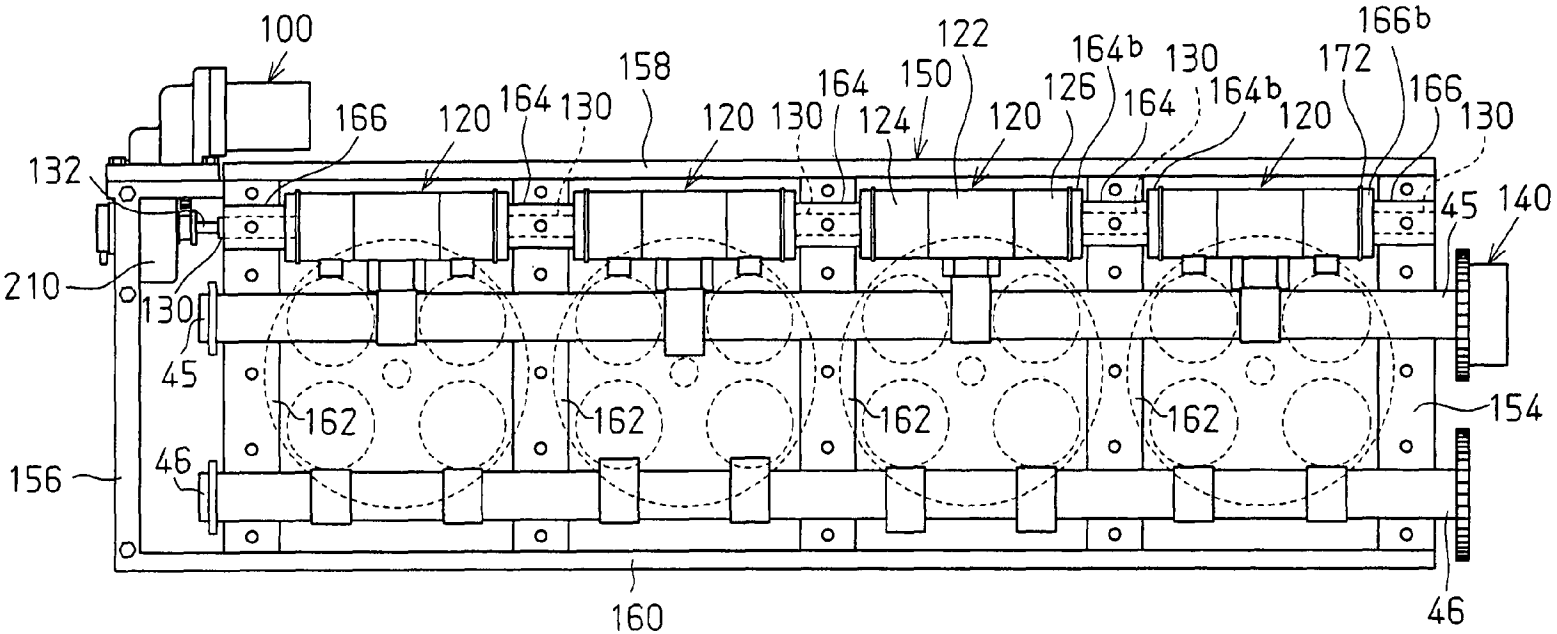
FIG. 3 is a plan view showing a cam carrier of the first embodiment.

The intake camshaft 45, the exhaust camshaft 46, the slide actuator 100, the variable valve lift mechanisms 120, and the variable valve timing mechanism 140 are incorporated as a single unit in the cam carrier 150. FIG. 3 shows a state in which five cam caps 152 are removed from the cam carrier 150.

The cam carrier 150 includes a front wall 154, a rear wall 156, and two side walls 158 and 160. In the internal space defined by the walls 154, 156, 158, and 160, four parallel bearings 162 extends so as to connect the side walls 158 and 160. The walls 154 to 160 and the bearing 162 are formed integrally. The front wall 154 also functions as a bearing. The cam carrier 150 is formed from the same aluminum alloy material as the cylinder block 4 and the cylinder head 8.

The bearings 162 and the front wall 154 support the intake camshaft 45 and the exhaust camshaft 46 in a manner that they are parallel to each other and rotatable. The four variable valve lift mechanisms 120, which are respectively arranged in correspondence with the cylinders 2*a*, three intermediate collars 164, and two end collars 166, are arranged between the intake camshaft 45 and the side wall 158. The three intermediate collars 164 are arranged between the four variable valve lift mechanisms 120. The two end collars 166 are arranged at the outer sides of the two outer variable valve lift mechanisms 120. A rocker shaft 130, which commonly extends through the four variable valve lift mechanisms 120, supports the collars 164 and 166.

Figure 4A:
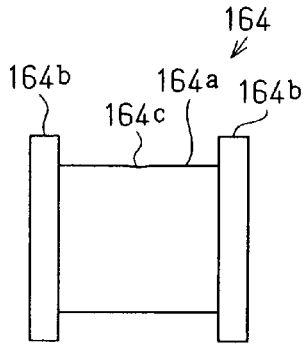
FIGS. 4A, 4B, and 4C are respectively plan, front, and perspective views showing an intermediate collar of the first embodiment.
Figure 4B:
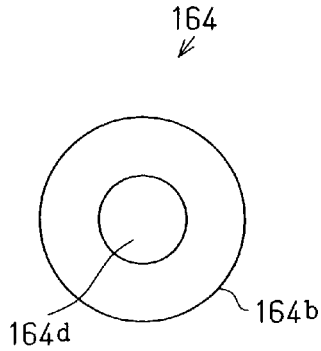
Figure 4C:
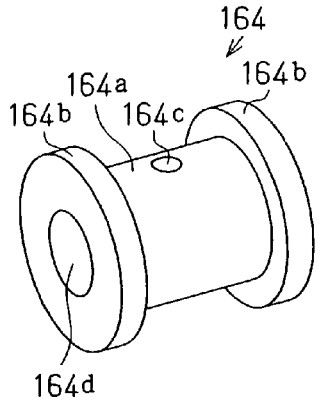

Referring to FIGS. 4A, 4B, and 4C, each intermediate collar 164 includes a cylindrical sleeve 164*a* and two flanges 164*b* formed on the two ends of the sleeve 164*a*. The intermediate collar 164 has an interior space 164*d* (center bore). A pin hole 164*c* formed in the sleeve 164*a* is connected to the interior space 164*d*.

Figure 5A:
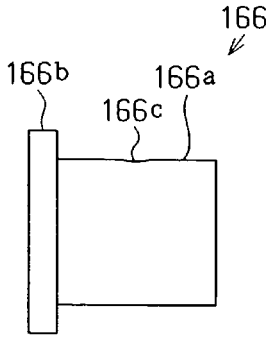
FIGS. 5A, 5B, and 5C are respectively plan, front, and perspective views showing an end collar of the first embodiment.
Figure 5B:
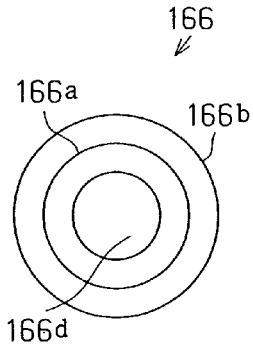
Figure 5C:
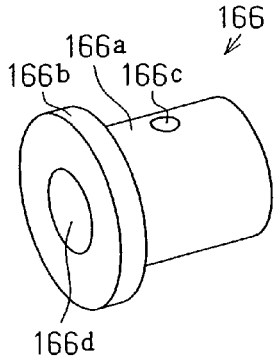
Figure 6:
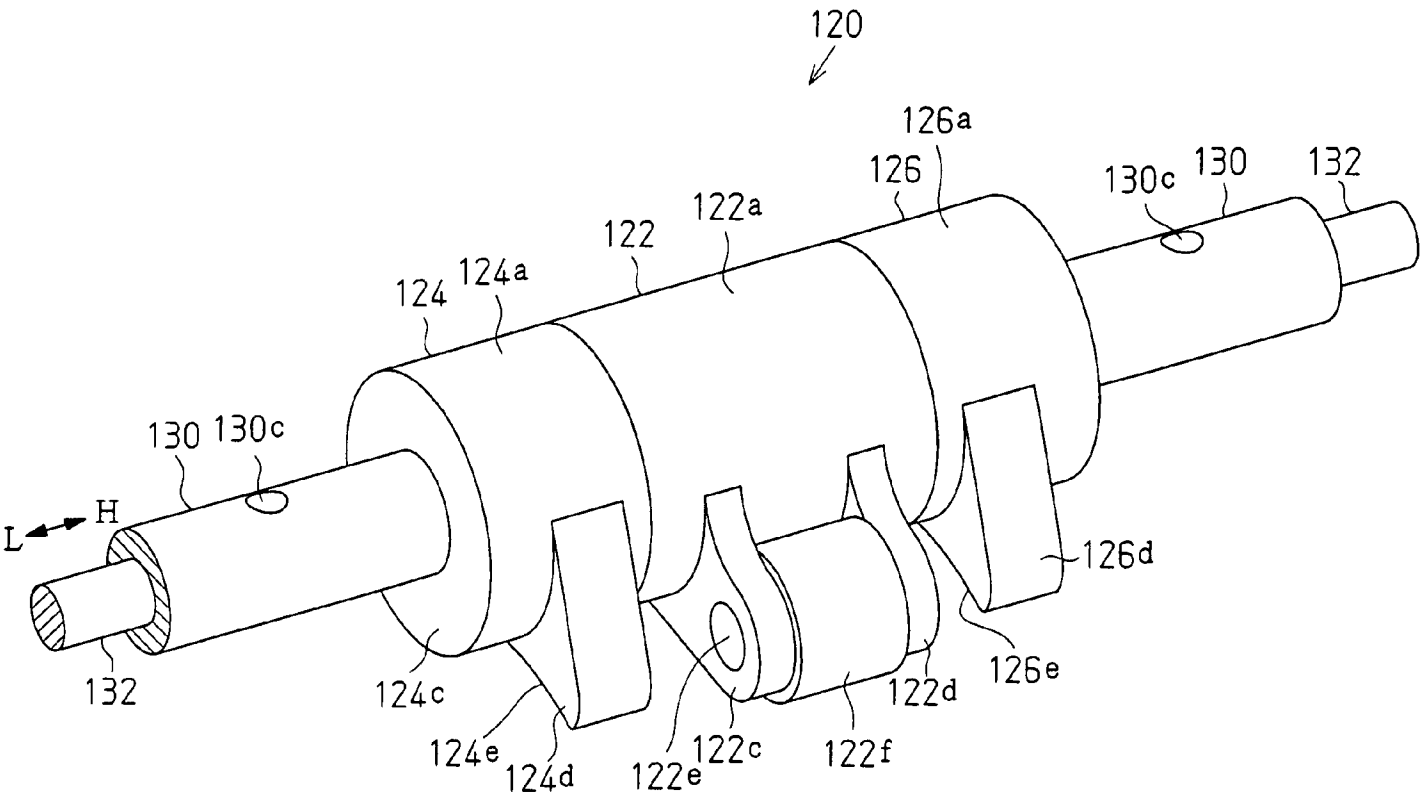
FIG. 6 is a perspective view showing a variable valve lift mechanism of the first embodiment.
Figure 7A:
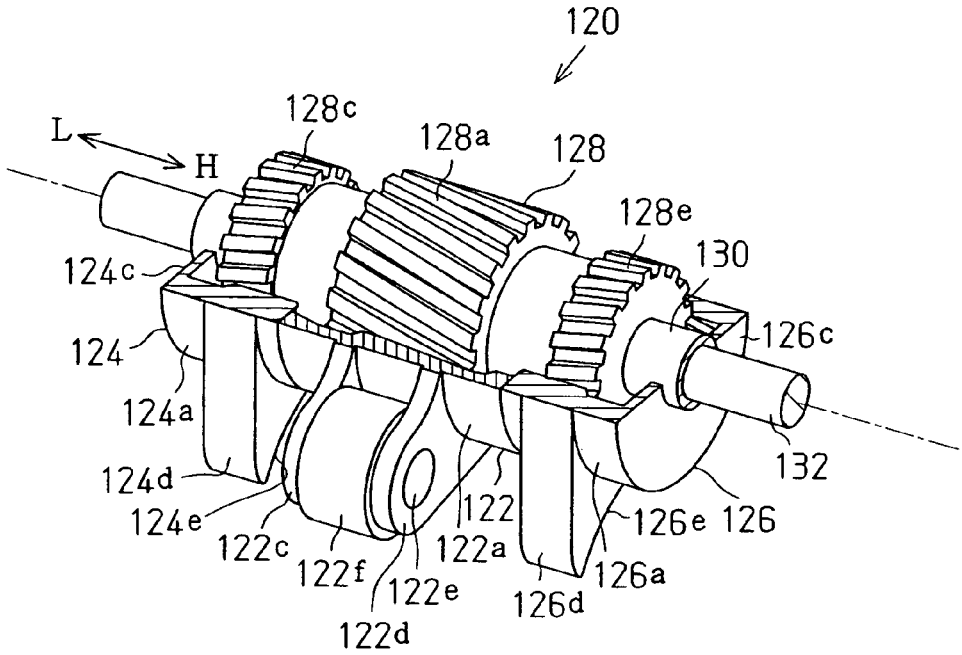
FIGS. 7A and 7B are partially cutaway perspective views showing the variable valve lift mechanism of the first embodiment.
Figure 7B:
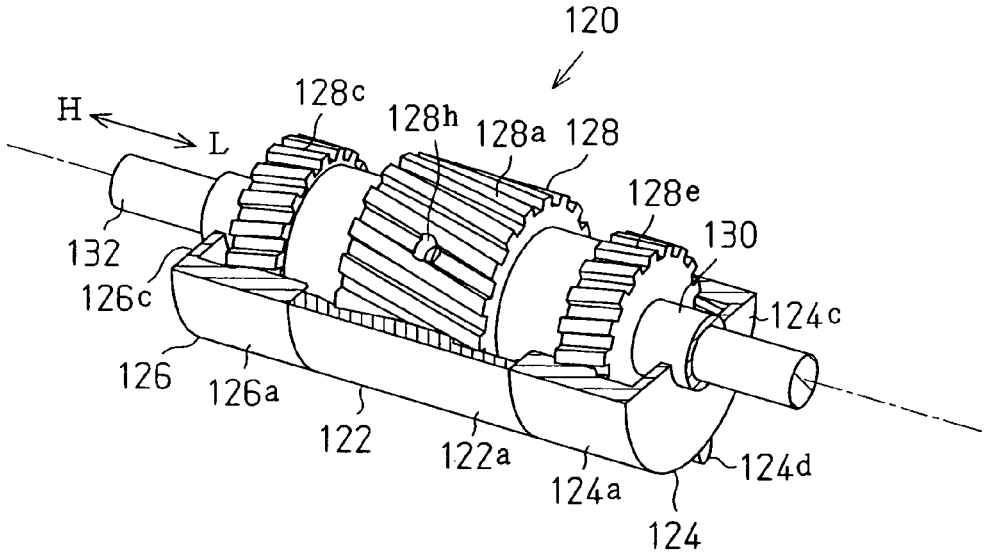

Referring to FIGS. 5A, 5B, and 5C, each end collar 166 includes a cylindrical sleeve 166*a* and a flange 166*b* formed on one end of the sleeve 166*a*. The end collar 166 has an interior space 166*d* (center bore). A pin hole 166*c* formed in the sleeve 166*a* is connected to the interior space 166*d*. The collars 164 and 166 are each formed integrally from a steel material.

The variable valve lift mechanisms 120 will now be discussed with reference to FIGS. 6 to 9.

Each variable valve lift mechanism 120 includes an input sleeve 122 (input portion), a first rocking cam 124 (output portion) arranged rearward from the input sleeve 122, a second rocking cam 126 (output portion) arranged frontward from the input sleeve 122, and a slider gear 128 arranged in the input sleeve 122.

The input sleeve 122 includes a housing 122*a* defining a cylindrical hollow space. A helical spline 122*b* (FIG. 9) is formed in the inner wall surface of the housing 122*a*. Each groove of the helical spline 122*b* extends helically about the axis of the housing 122*a* in the direction of a right-hand thread. Two parallel arms 122*c* and 122*d* extend from the outer walls surface of the housing 122*a*. A pin 122*e* extends between the distal ends of the arms 122*c* and 122*d*. The pin 122*e* extends parallel to the axis of the housing 122*a*. Further, the pin 122*e* rotatably supports a roller 122*f*. Referring to FIG. 1, the force of an urging member, such as a spring, constantly pushes the roller 122*f* towards the intake cam 45*a*. The urging member may be arranged, for example, between the input sleeve 122 and the cylinder head 8 or rocker shaft 130.

The first rocking cam 124 includes a housing 124*a* that defines a cylindrical internal space. A helical spline 124*b* (FIG. 9) is formed in the inner wall surface of the housing 124*a*. Each groove of the helical spline 124*b* extends helically about the axis of the housing 124*a* in the direction of a left-hand thread. The housing 124*a* includes a bearing end 124*c* having an end face in which a small center hole is formed. A triangular nose 124*d* extends from the outer wall surface of the housing 124*a*. The nose 124*d* includes a cam surface 124*e* curved in a concave manner.

The second rocking cam 126 includes a housing 126*a* that defines a cylindrical internal space. A helical spline 126*b* (FIG. 9) is formed in the inner wall surface of the housing 126*a*. Each groove of the helical spline 126*b* extends helically about the axis of the housing 126*a* in the direction of a left-hand thread. The housing 126*a* includes a bearing end 126*c* having an end face in which a small center hole is formed. A triangular nose 126*d* extends from the outer wall surface of the housing 126*a*. The nose 126*d* includes a cam surface 126*e* curved in a concave manner.

Figure 8:
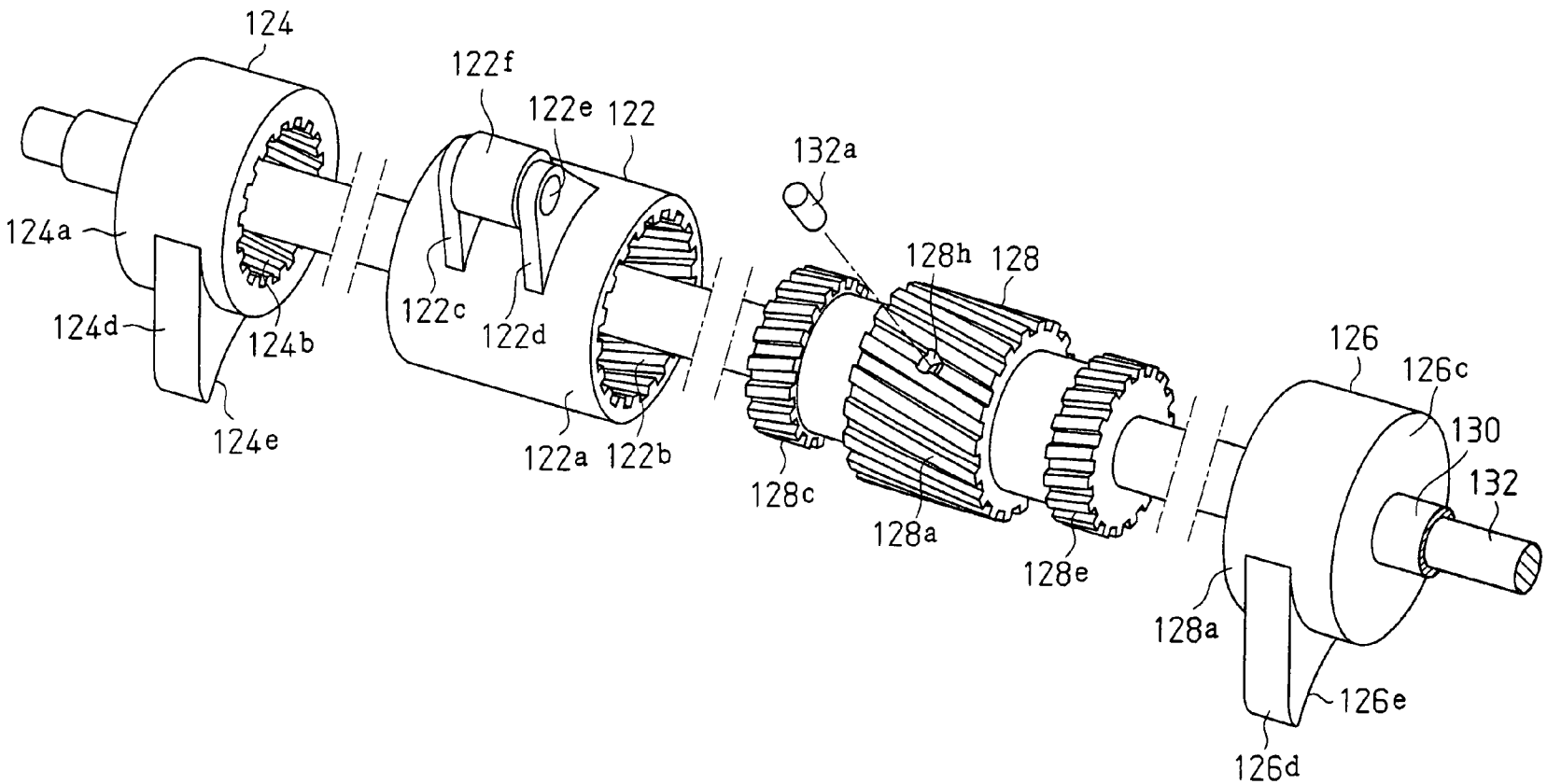
FIG. 8 is an exploded perspective view showing the variable valve lift mechanism of FIG. 6.
Figure 9A:
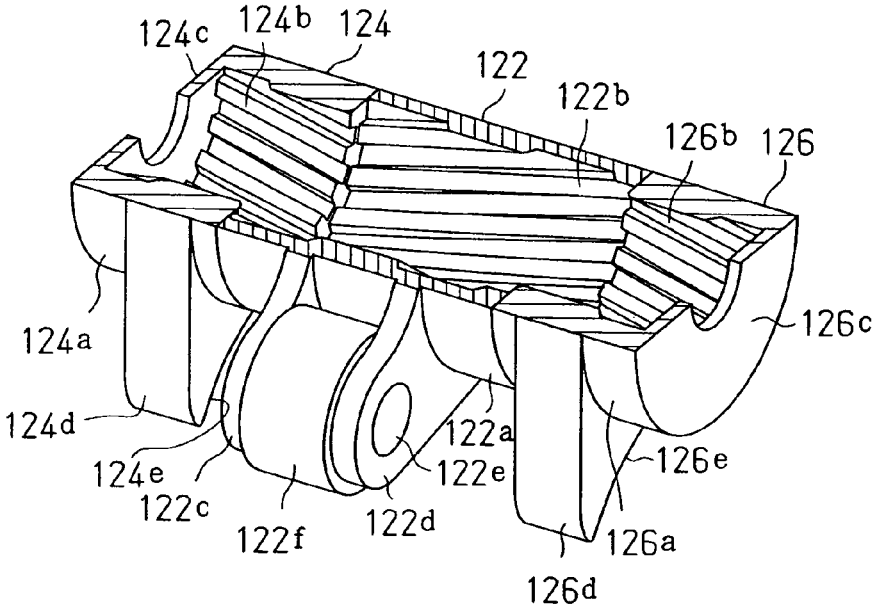
FIGS. 9A and 9B are partially cutaway perspective views showing the variable valve lift mechanism of FIG. 6.
Figure 9B:
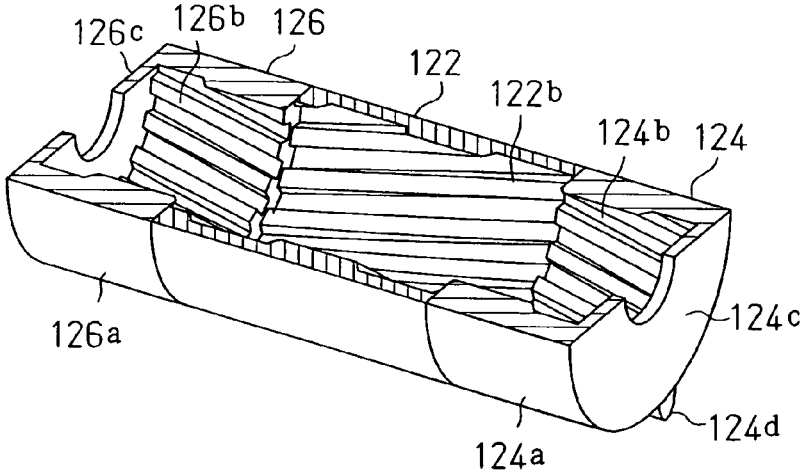

Referring to FIG. 8, the first rocking cam 124, the input sleeve 122, and the second rocking cam 126 are coaxially aligned. The first rocking cam 124 and the second rocking cam 126 contact opposite ends of the input sleeve 122. The housings 122*a*, 124*a*, and 126*a* define a single internal space.

Figure 10A:
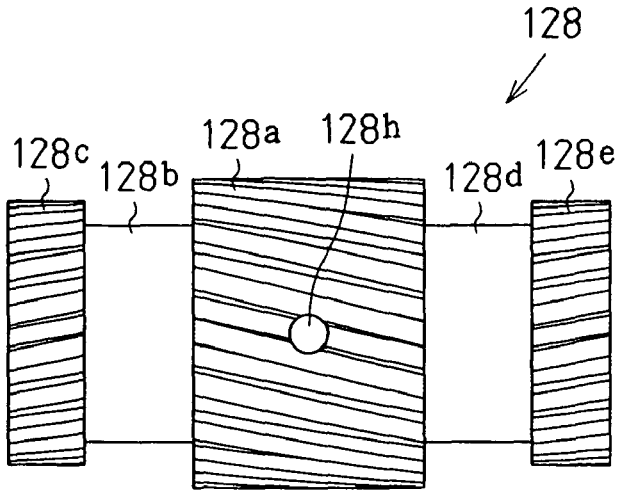
FIGS. 10A, 10B, and 10C are plan views and a front view showing a slider gear of the first embodiment.
Figure 10B:
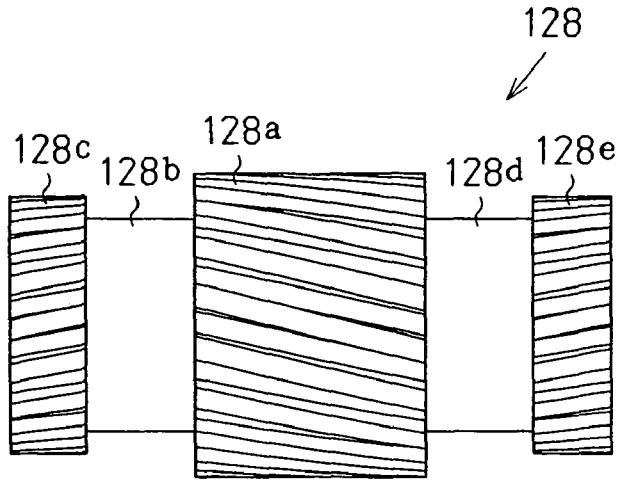
Figure 10C:
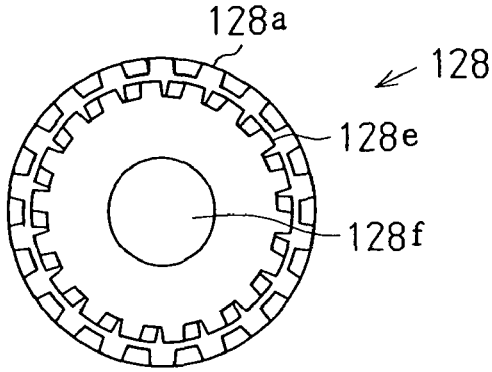
Figure 11:
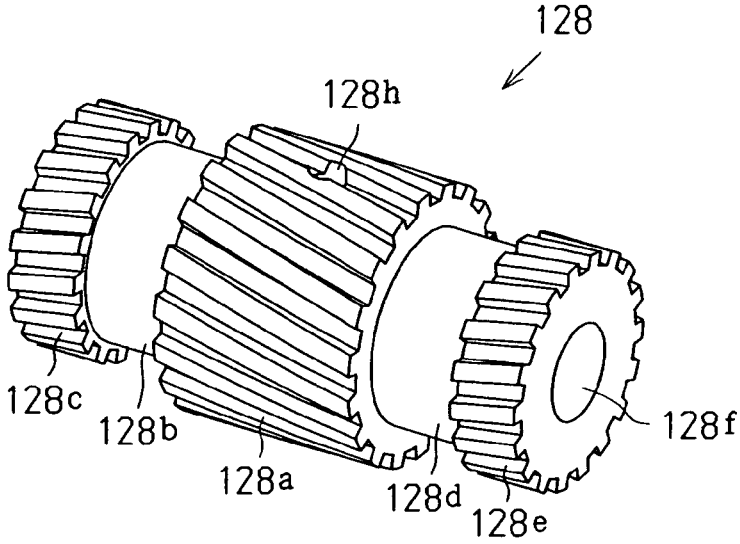
FIG. 11 is a perspective view showing the slider gear of FIGS. 10A, 10B, and 10C.
Figure 12:
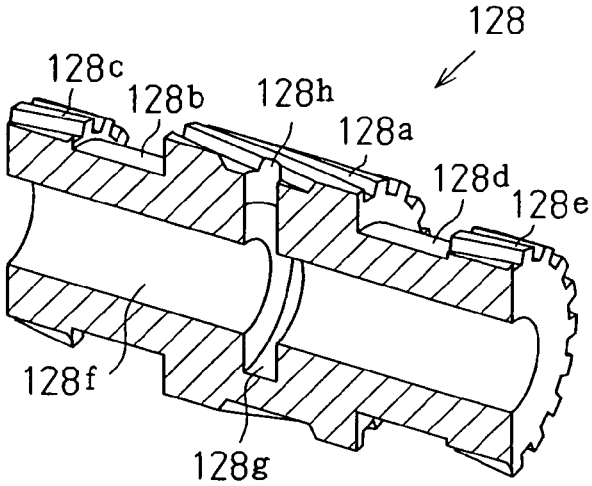
FIG. 12 is a partial cutaway perspective view showing the slider gear of FIG. 11.

FIGS. 10 to 12 show the slider gear 128 retained in the housings 122*a*, 124*a*, and 126*a*. The slider gear 128 includes an input helical spline 128*a*, a first output helical spline 128*c*, and a second helical spline 128*e*. Each groove of the input helical spline 126*b* extends helically about the axis of the slider gear 128 in the direction of a right-hand thread. A small diameter portion 128*b* is formed between the input helical spline 128*a* and the first output helical spline 128*c*. A further small diameter portion 128*d* is formed between the input helical spline 128*a* and the second output helical spline 128*e*. Each groove of the first output helical spline 128*c* and the second output helical spline 128*e* extend helically about the axis of the slider gear 128 in the direction of a left-hand thread. The diameter of the first output helical spline 128*c* and the diameter of the second output helical spline 128*e* are smaller than that of the input helical spline 128*a*.

Referring to FIG. 12, a gear bore 128*f* extends through the slider gear 128 along the slider gear axis. A circumferential groove 128*g* is formed in the inner wall surface of the gear bore 128*f* in the input helical spline 128*a*. A pin insertion hole 128*h* connects the circumferential groove 128*g* and the input helical spline 128*a*.

Figure 13A:
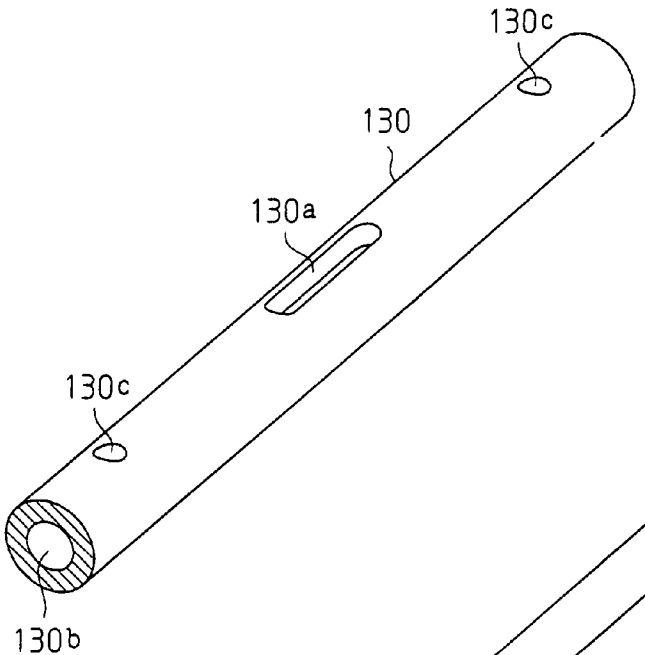
FIG. 13A is a perspective view showing a rocker shaft of the first embodiment.

FIG. 13A shows part of the rocker shaft 130. The gear bore 128*f* of the slider gear 128 rotatably receives the rocker shaft 130. As shown in FIG. 3, the four variable valve lift mechanisms 120 are mounted on the single rocker shaft 130.

The rocker shaft 130 is hollow and includes an interior space 130*b*. Four elongated holes 130*a* are formed in the outer surface of the rocker shaft 130 at positions corresponding to the variable valve lift mechanisms 120.

Figure 13B:
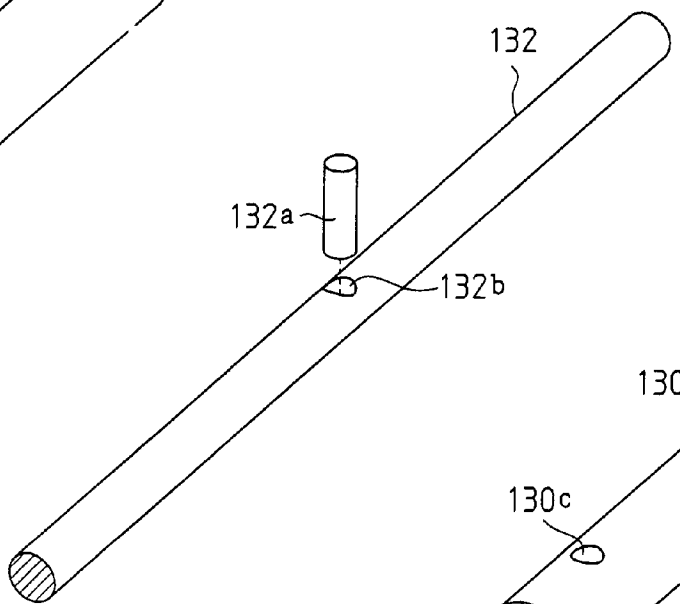
FIG. 13B is a perspective view showing a control shaft of the first embodiment.
Figure 13C:
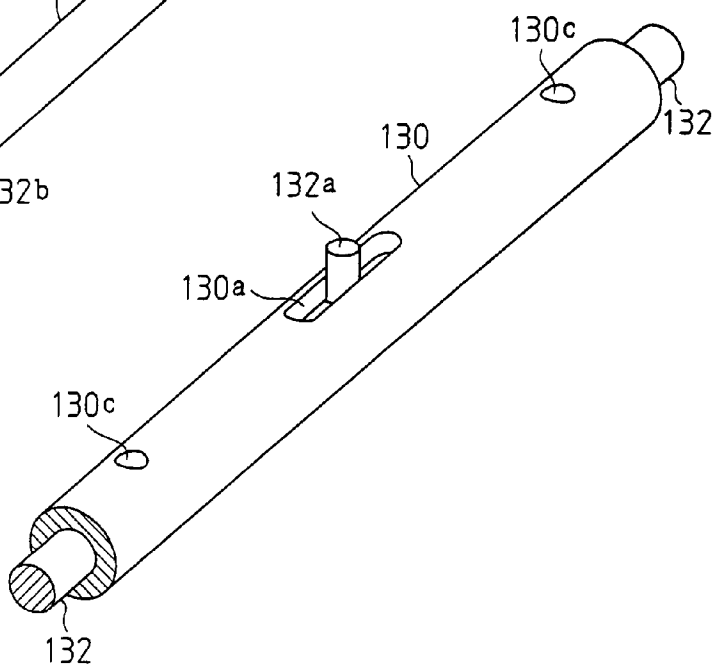
FIG. 13C is a perspective view showing the rocker shaft retained in the control shaft of FIG. 13B.

FIG. 13B shows part of the control shaft 132. The control shaft 132 has a round cross-section. Referring to FIG. 13C, the control shaft 132 is received in the rocker shaft 130 and axially movable.

The control shaft 132 includes support holes 132*b* respectively located at positions corresponding to the variable valve lift mechanisms 120. Each support hole 132*b* receives the basal portion of a control pin 132*a*. Each control pin 132*a*, which is supported by the corresponding support hole 132*b*, extends perpendicular to the axis of the control shaft 132.

Figure 14:
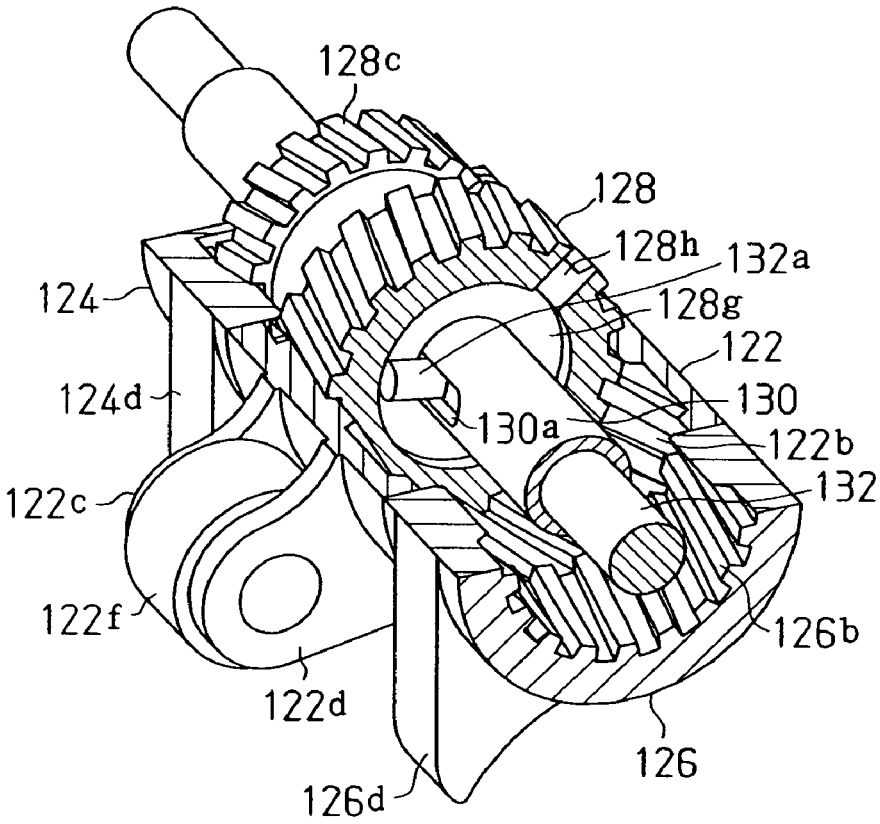
FIG. 14 is a partial cutaway perspective view showing the variable valve lift mechanism of FIG. 6.

When the control shaft 132 is received in the rocker shaft 130, each control pin 132*a* projects from the corresponding elongated hole 130*a* of the rocker shaft 130. Referring to FIG. 14, the distal end of each control pin 132*a* is located in the circumferential groove 128*g* of the slider gear 128.

The rocker shaft 130, the control shaft 132, and the control pin 132*a* are formed from a steel material and have high strength.

Figure 16:
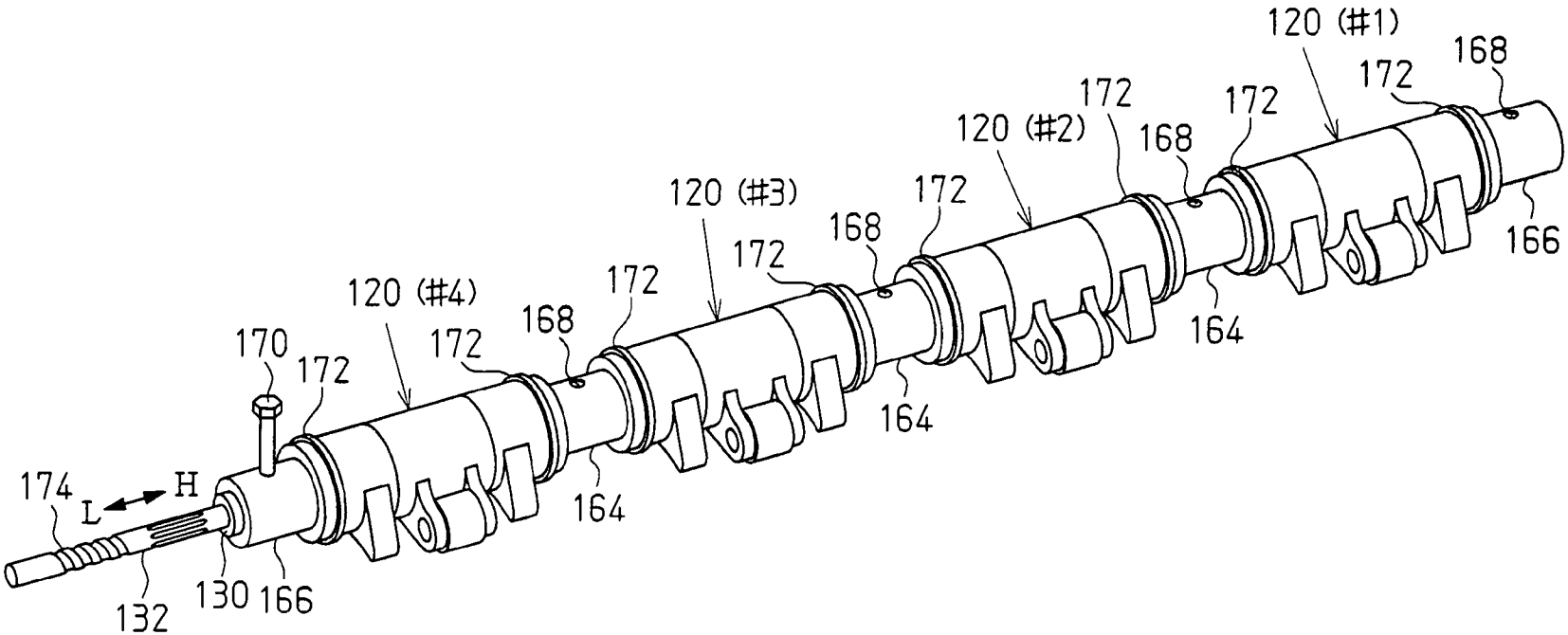
FIG. 16 is a perspective view showing the collars fastened to the control shaft and the variable valve lift mechanisms.

Referring to FIG. 16, a ball screw shaft 174 is formed on one end of the control shaft 132. The ball screw shaft 174 transmits the drive force of the slide actuator 100 to the control shaft 132.

The assembly of the variable valve lift mechanisms 120, the rocker shaft 130, the control shaft 132, and the collars 164 and 166 will now be described.

Figure 15:
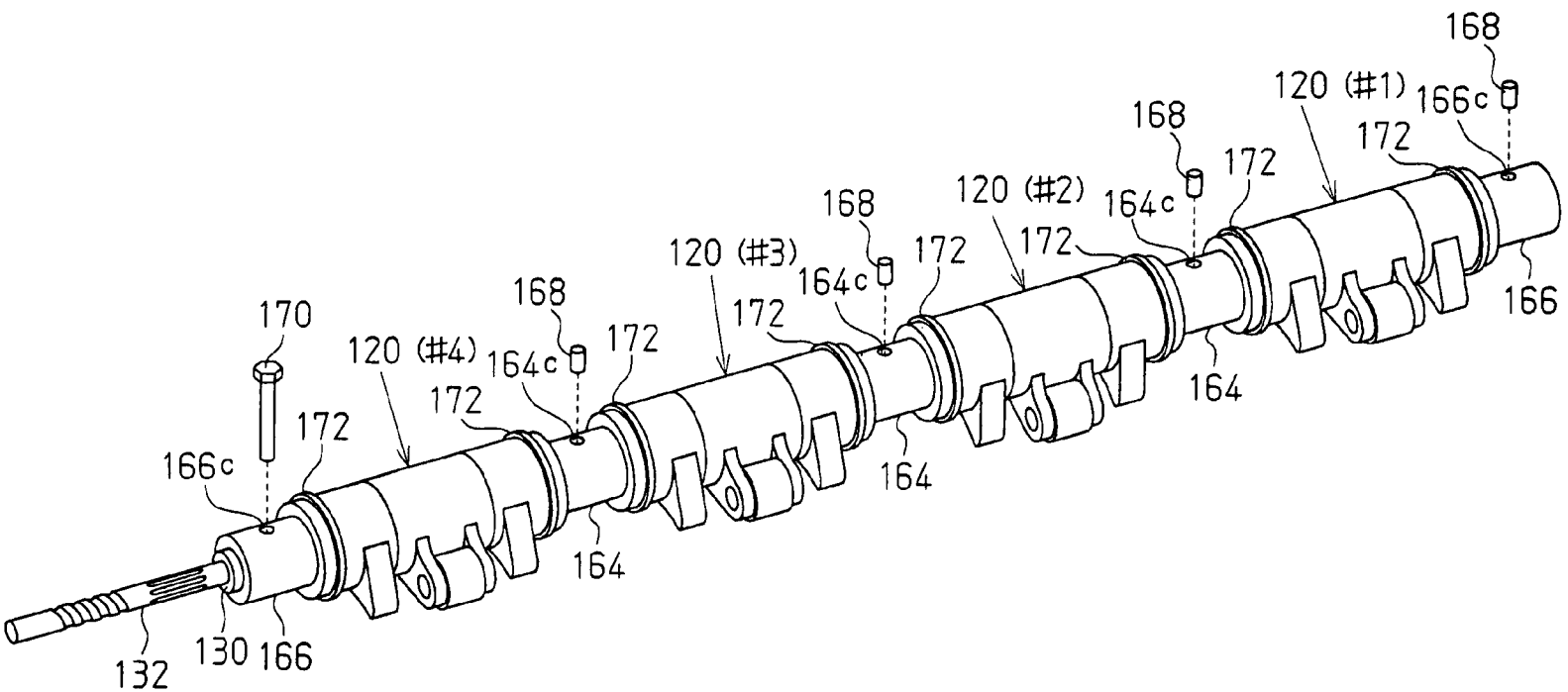
FIG. 15 is a perspective view showing a plurality of collars arranged between variable valve lift mechanisms.

The control shaft 132 is first inserted through the rocker shaft 130. Referring to FIG. 15, the variable valve lift mechanisms 120 and the collars 164 and 166 are alternately fastened to the rocker shaft 130. Referring to FIG. 8, the control pins 132*a* are inserted in the pin insertion holes 128*h* of the corresponding slider gears 128 and the elongated holes 130*a* of the rocker shaft 130 and fastened to the control shaft 132 in the support holes 132*b*. Referring to FIG. 15, fastening pins 168 are inserted through the pin holes 164*c* and 166*c* of the collars 164 and 166 and fastened to the rocker shaft 130 in pin holes 130*c* (FIG. 13). This fastens the collars 164 and 166 to the rocker shaft 130.

Among the five cam caps 152, the distal end of a bolt 170 for fastening the cam cap 152 located near the slide actuator 100 is inserted through the pin hole 166*c* of the corresponding collar 166 and into the pin hole 130*c* of the rocker shaft 130. Accordingly, the collar 166 located near the slide actuator 100 is fixed to the rocker shaft 130 by the bolt 170 when fastening the cam cap 152. In this manner, as shown in the state of FIG. 16, the variable valve lift mechanisms 120, the rocker shaft 130, the control shaft 132, and the collars 164 and 166 are assembled as a single unit. In this state, the flanges 164*b* and 166*b* of the collars 164 and 166 are in contact with the end faces of the adjacent variable valve lift mechanisms 120.

During the assembly, shim plates 172, which are formed from a steel material, are arranged between the variable valve lift mechanisms 120 and the collars 164 and 166 if necessary to adjust the position of each variable valve lift mechanism 120. In this case, the flanges 164*b* and 166*b* of the collars 164 and 166 indirectly contact the end faces of the adjacent variable valve lift mechanisms 120.

The shaft assembly shown in FIG. 16 is formed from a steel material. Referring to FIG. 2, the shaft assembly is secured to the cam carrier 150 by five cam caps 152. The bolt 170 for fastening the cam cap 152 that is close to the slide actuator 100 restricts movement of the shaft assembly in the axial direction. The bolts for fastening the other three cam caps 152 do not restrict movement of the collars 164 and 166 in the axial direction.

Figure 17:
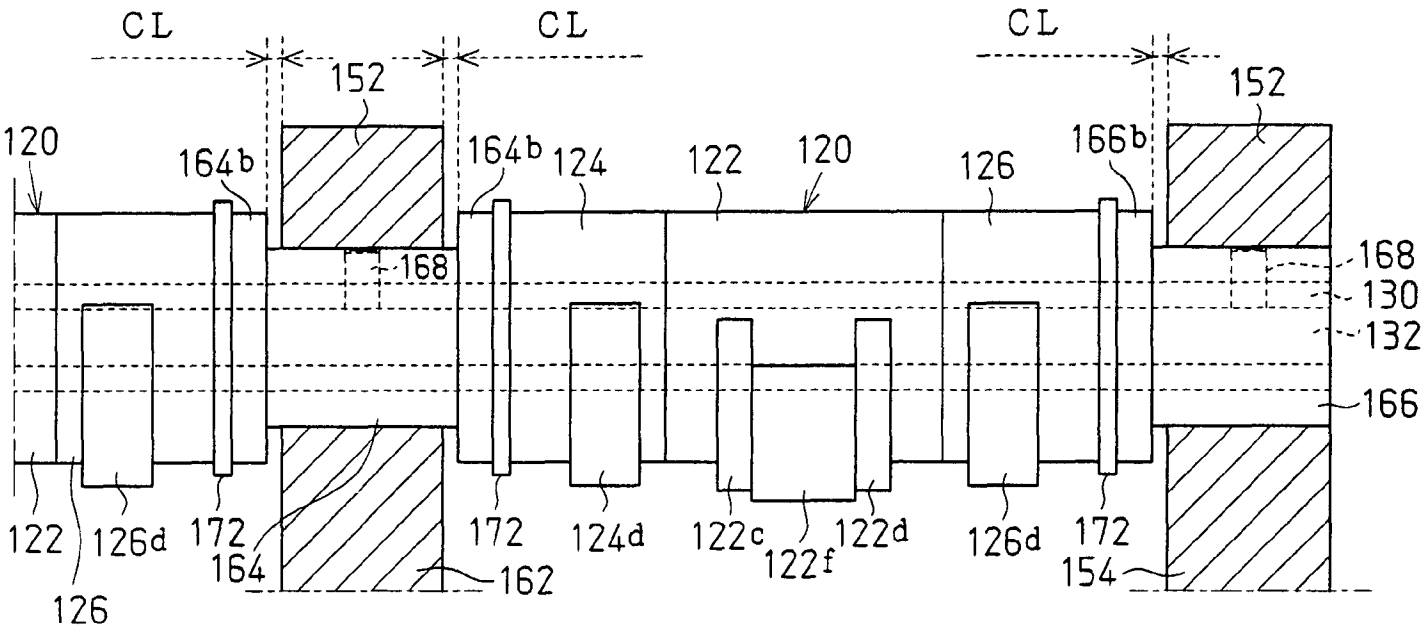
FIG. 17 is a diagram showing clearances formed between the collars and the cam carriers.

As shown in FIGS. 2 and 3, the lengths of the sleeves 164*a* and 166*a* of the collars 164 and 166 in the axial direction are greater than the thicknesses of the front wall 154, the bearings 162, and the cam caps 152. Referring to FIG. 17, clearances CL are formed between the flanges 164*b* and 166*b* and the adjacent front wall 154 or bearing 162 and cam cap 152. Even if there is a difference in the expansion and contraction amount of the control shaft 132 and the cam carrier 150 due to a difference in the coefficient of thermal expansion, the collars 164 and 166, excluding the collar 166 fastened by the bolt 170, move in the axial direction of the control shaft 132 and absorb the difference in the expansion and contraction amounts. Accordingly, the axial positions of the variable valve lift mechanisms 120 do not change, and the relative positions of the control shaft 132 and the variable valve lift mechanisms 120 in the axial direction do not change.

The slide actuator 100 drives a ball screw mechanism 210 (FIGS. 2 and 3) to move the control shaft 132, which includes the ball screw shaft 174, in the axial movement. The movement adjusts the axial position of the slider gear 128 in each variable valve lift mechanism 120.

Referring to FIG. 14, the control pin 132*a* is received in the circumferential groove 128*g* of the slider gear 128. Thus, the slider gear 128 is rotatable relative to the control shaft 132 regardless of the position of the control pin 132*a*.

The input helical spline 128*a* of the slider gear 128 meshes with the helical spline 122*b* of the input sleeve 122. The first output helical spline 128*c* meshes with the helical spline 124*b* of the first rocking cam 124. The second output helical spline 128*e* meshes with the helical spline 126*b* of the second rocking cam 126. The input splines 122*b* and 128*a* differ from the splines 124*b*, 128*c*, 126*b*, and 128*e* in the helical direction (helical angle) relative to the control shaft 132.

Referring to FIG. 16, the collars 164 and 166 are arranged on opposite sides of each variable valve lift mechanism 120. This restricts axial movement of the input sleeve 122 and the rocking cams 124 and 126 in each variable valve lift mechanism 120 relative to the rocker shaft 130. Thus, even if the control shaft 132 axially moves the slider gears 128, axial movement of the input sleeves 122 and the rocking cams 124 and 126 is restricted.

When the slide actuator 100 axially moves the control shaft 132, the slider gear 128 axially moves in the internal space of the corresponding variable valve lift mechanism 120. The helical splines 128*a*, 122*b*, 128*c*, 124*b*, 128*e*, and 126*b* function to relatively rotate the input sleeve 122 and the rocking cams 124 and 126. In this embodiment, the input sleeve 122 rotates in a direction opposite to that of the rocking cams 124 and 126. The rotation angle of the input sleeve 122 and the rocking cams 124 and 126 are determined in accordance with the movement of the slider gear 128. Accordingly, adjustment of the movement amount of the control shaft 132 changes the positions (angle along the circumferential direction of the rocker shaft 130) of the rollers 122*f* relative to the noses 124*d* and 126*d*. This adjusts the lift amount of the intake valves 12.

Figure 18B:
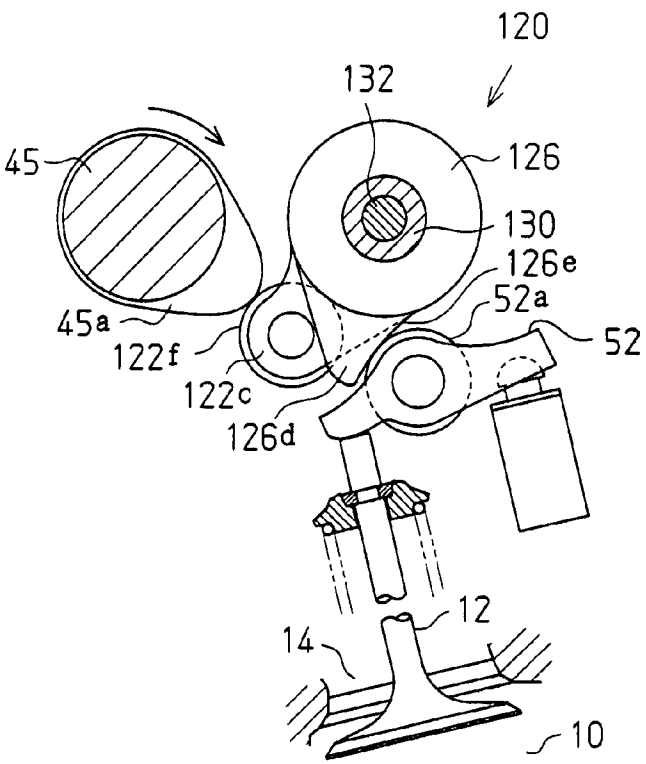
FIGS. 18A, 18B, 19A, and 19B show the operation of the variable valve lift mechanism of FIG. 6.
Figure 18A:
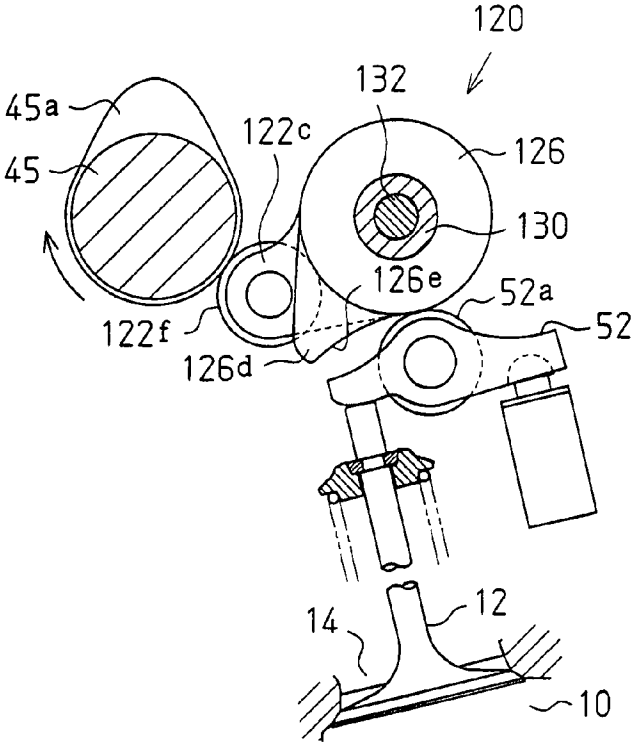

FIG. 18A shows the intake valve 12 when it is closed and FIG. 18B shows the intake valve 12 when it is open in a state in which the control shaft 132 is moved by the maximum amount in direction L (FIG. 16). In this state, the angle between the roller 122*f* and the nose 126*d* (124*d*) in each variable valve lift mechanism 120 is minimal. Thus, referring to FIG. 18B, the amount the cam surfaces 124*e* and 126*e* of the noses 124*d* and 126*d* push the rocker roller 52*a* down, that is, the maximum lift amount of the intake valve 12 is relatively small. In this case, the amount of air supplied to each combustion chamber 10 from the corresponding intake port 14 is minimal.

Figure 19B:
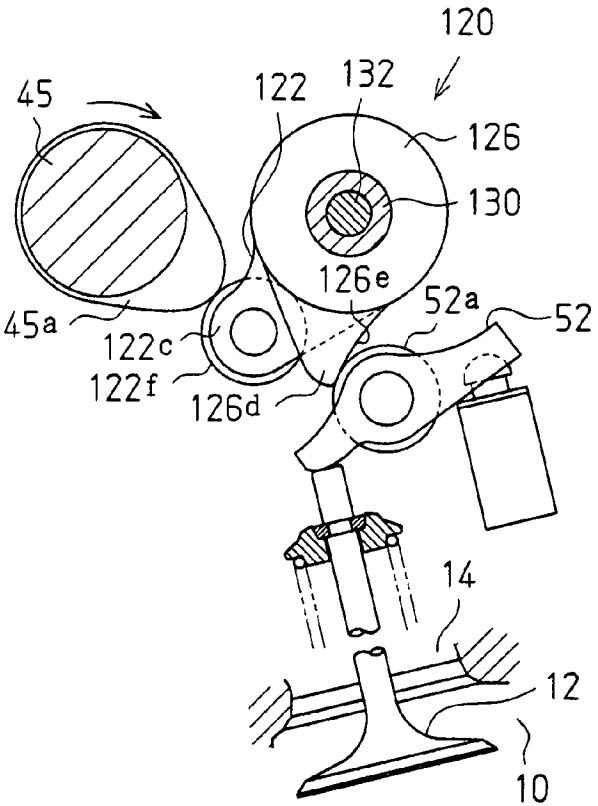
Figure 19A:
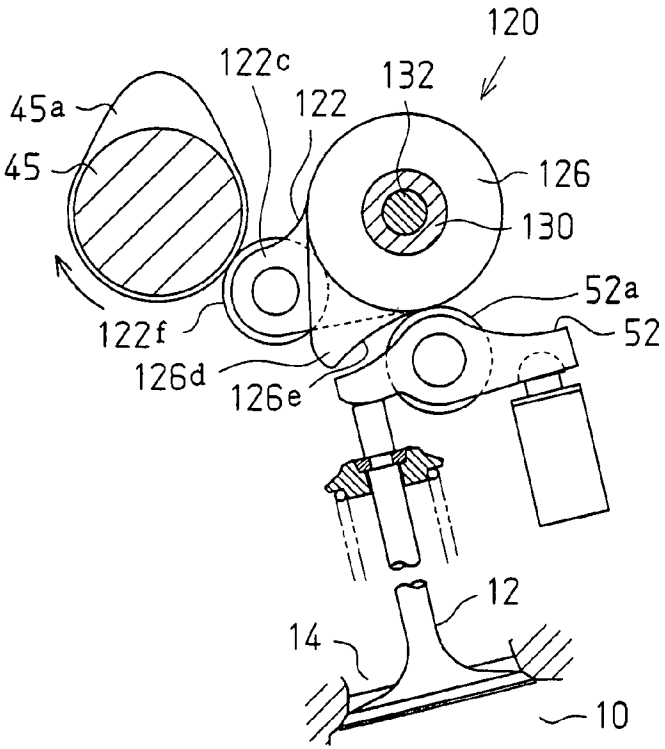

FIG. 19A shows the intake valve 12 when it is closed and FIG. 19B shows the intake valve 12 when it is open in a state in which the control shaft 132 is moved by the maximum amount in direction H (FIG. 16). In this state, the angle between the roller 122*f* and the nose 126*d* (124*d*) in each variable valve lift mechanism 120 is maximal. Thus, referring to FIG. 19B, the amount the cam surfaces 124*e* and 126*e* of the noses 124*d* and 126*d* push the rocker roller 52*a* down, that is, the minimum lift amount of the intake valve 12 is relatively large. In this case, the amount of air supplied to each combustion chamber 10 from the corresponding intake port 14 is maximal.

The control shaft 132 axially moves between the state of FIG. 18 and the state of FIG. 19 in a continuous (stepless) manner. Adjustment of the movement amount of the control shaft 132 adjusts the lift amount of each intake valve 12 in a continuous (stepless) manner. Accordingly, the intake air amount is adjustable in a stepless manner without using a throttle valve.

In the example of FIG. 18B, when the lift amount of the intake valve 12 is minimal, the intake port 14 is slightly open. However, the intake port 14 may be closed when the lift amount of the intake valve 12 is minimal. This is a state in which the minimal lift amount of the intake valve 12 is zero and the intake air amount is zero.

In the first embodiment, the rocker shaft 130 functions as a shaft (hollow shaft). The front wall 154 and the bearings 162 of the cam carrier 150 function as supports. The flanges 164*b* and 166*b* formed on the ends of the sleeves 164*a* and 166*a* function to position the variable valve lift mechanisms 120. The shaft assembly (FIG. 16) including the variable valve lift mechanisms 120, the ball screw mechanism 210, and the slide actuator 100 form a variable valve actuation mechanism.

The first embodiment has the advantages described below.

The ends of the collars 164 and 166, or the flanges 164*b* and 166*b*, directly contact the end faces of the rocking cams 124 and 126 or indirectly contact the end faces of the rocking cams 124 and 126 by means of the shim plates 172 in the variable valve lift mechanisms 120. This contact determines the distance (positional relationship) between the variable valve lift mechanisms 120 in the axial direction. The flanges 164*b* and 166*b* are spaced from the front wall 154, the bearings 162, and the cam caps 152 by clearance C. Accordingly, changes in the interval of the supports (front wall 154 and bearings 162) in the cam carrier 150 does not affect the positional relationship between the variable valve lift mechanisms 120. Even if a difference in coefficient of thermal expansion exists between the cam carrier 150 and the control shaft 132, the coefficient of thermal expansion of the cam carrier 150 does not affect the positional relationship of the variable valve lift mechanisms 120.

The coefficient of thermal expansion of the collars 164 and 166, the input sleeves 122, and the rocking cams 124 and 126 affect the positional relationship of the variable valve lift mechanisms 120. However, the collars 164 and 166, the input sleeves 122, and the rocking cams 124 and 126 are formed from a steel material having a coefficient of thermal expansion that is the same or approximate to that of the material the control shaft 132 is formed from. Accordingly, even if temperature changes affect the collars 164 and 166, the input sleeves 122, and the rocking cams 124 and 126, the change in the positional relationship of the slider gears 128, which is determined by the control shaft 132, is substantially the same as the change in the positions of the input sleeve 122 and the rocking cams 124 and 126. Thus, the intake valves 12 have substantially the same lift amount in all of the cylinders. Since temperature changes do not cause differences between cylinders in the lift amount of the intake valves 12, the accuracy of lift amount adjustment is improved.

Figure 20:
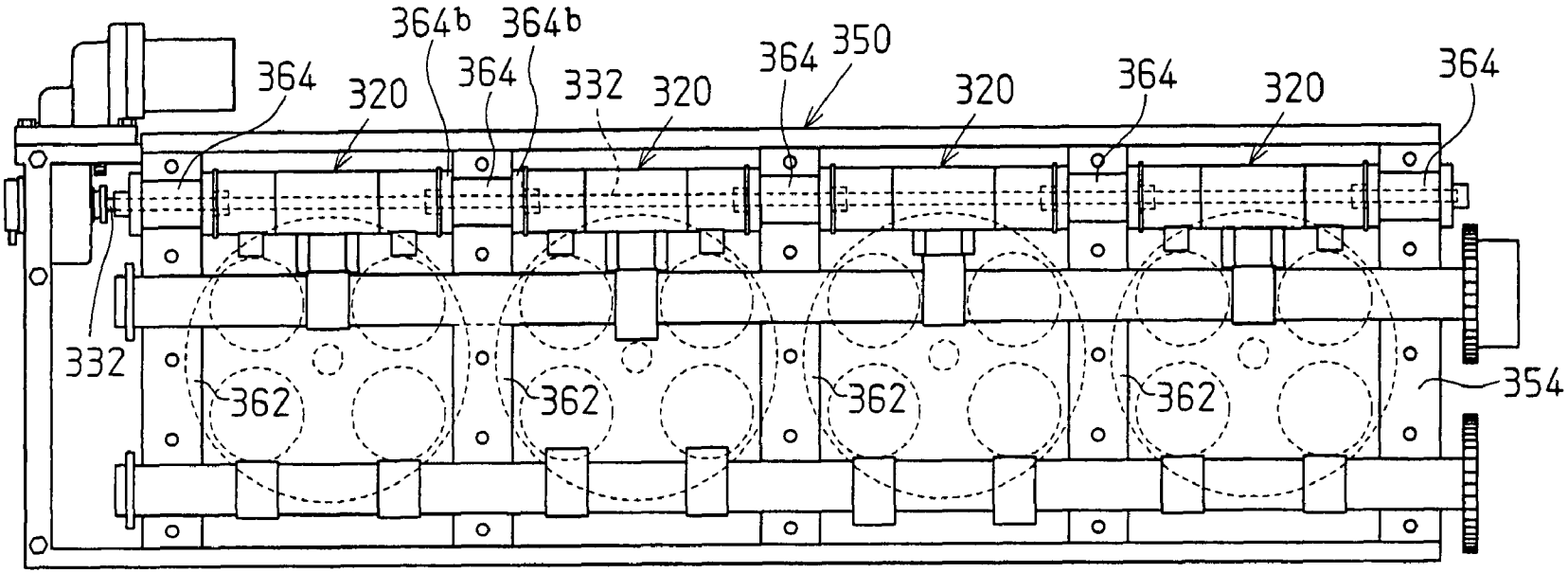
FIG. 20 is a plan view showing a cam carrier according to a second embodiment of the present invention.

A variable valve actuation mechanism according to a second embodiment of the present invention is similar to that of the first embodiment except in that the rocker shaft 130 is omitted. A plurality of collars 364 (FIG. 21) are used in lieu of the collars 164 and 166 of the first embodiment. Referring to FIG. 20, the collars 364 function as pivot shafts of variable valve lift mechanisms 320. FIG. 20, which corresponds to FIG. 3 of the first embodiment, shows a cam carrier 350 from which cam caps are removed. In the second embodiment, the cylinder block, the cylinder head, and the cam carrier 350 are formed from a steel material.

Figure 21A:
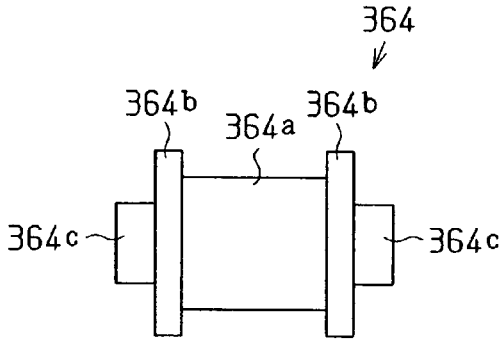
FIGS. 21A, 21B, and 21C are respectively front, side, and perspective views showing a collar of the second embodiment.
Figure 21B:
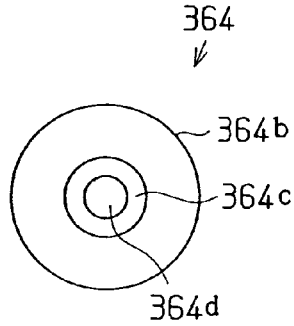
Figure 21C:
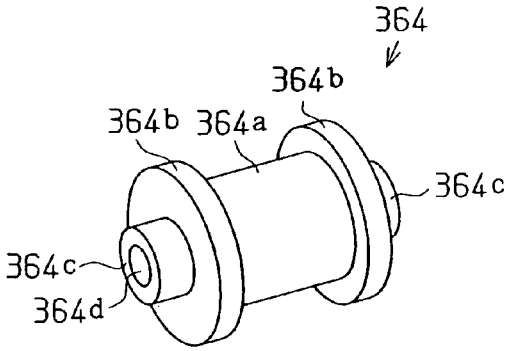

Referring to FIG. 21, each collar 364 includes a cylindrical sleeve 364*a*, two flanges formed on the two ends of the sleeve 364*a*, and a shaft projection or pivot shaft portion 364*c* extending from each flange 364*b* along the axis of the sleeve 364*a*. The collar 364 has a center bore 364*d*. Further, the collar 364 is formed from a steel material.

Figure 22:
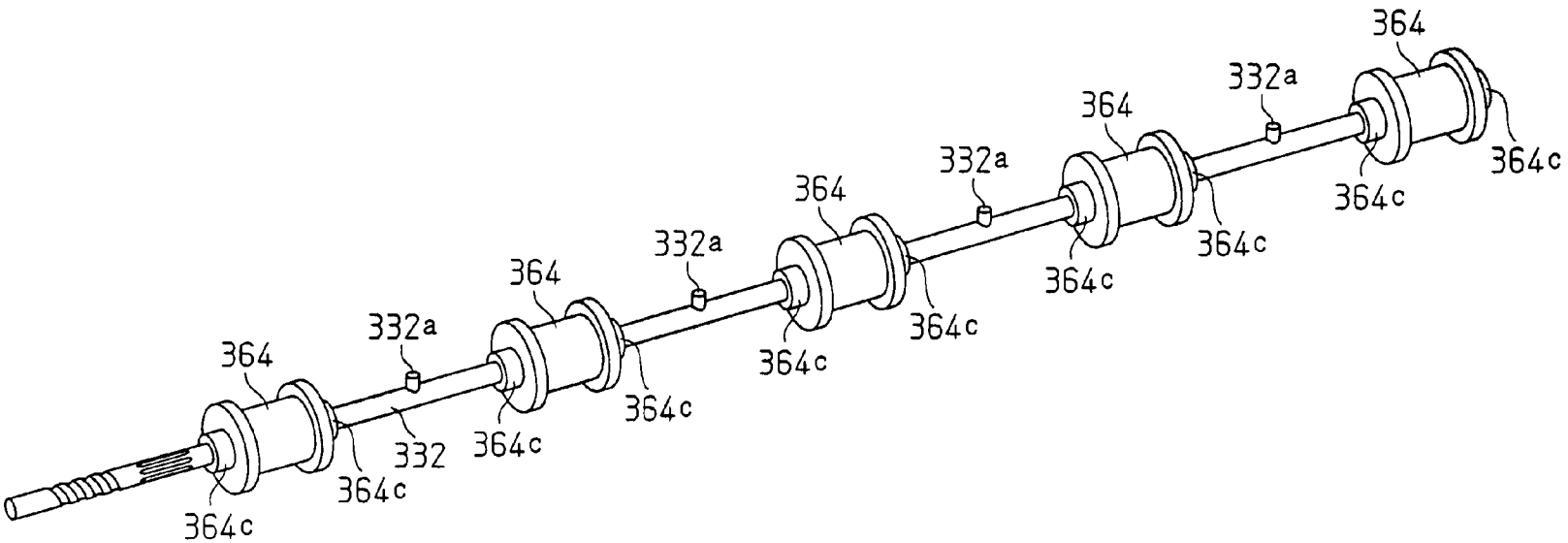
FIG. 22 is a perspective view showing a plurality of collars fastened to a control shaft.
Figure 23:
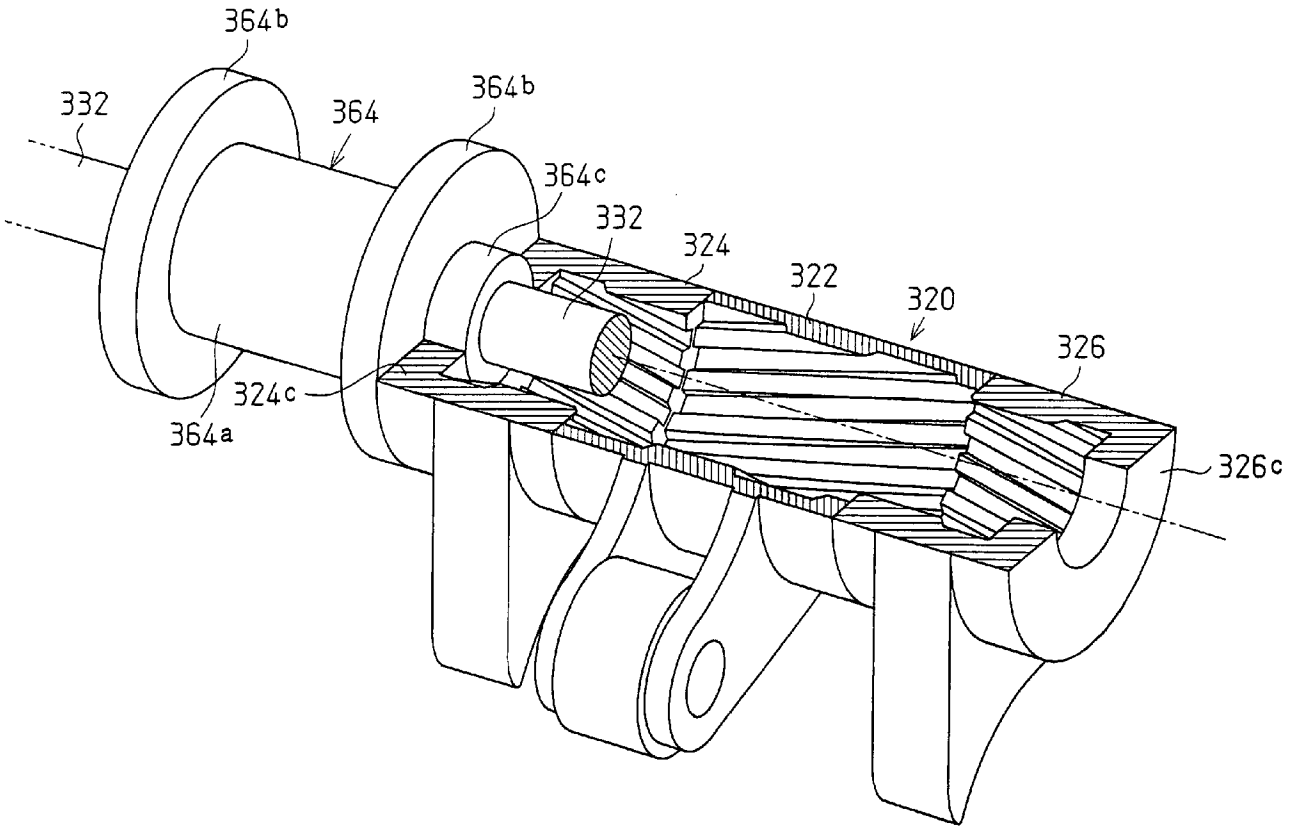
FIGS. 23 and 24 are enlarged cross-sectional diagrams showing the joint between a collar and variable valve lift mechanism.

Referring to FIG. 22, a control shaft 332 extends through the center bores 364*d* of the collars 364. The control shaft 332 directly supports the collars 364. Referring to FIG. 23, the pivot shaft portions 364*c* of each collar 364 are received by bearing ends 324*c* and 326*c* of the adjacent variable valve lift mechanism 320. This rotably supports the rocking cams 324 and 326 of each variable valve lift mechanism 320 with the pivot shaft portions 364*c* of the two adjacent collars 364.

Figure 24:
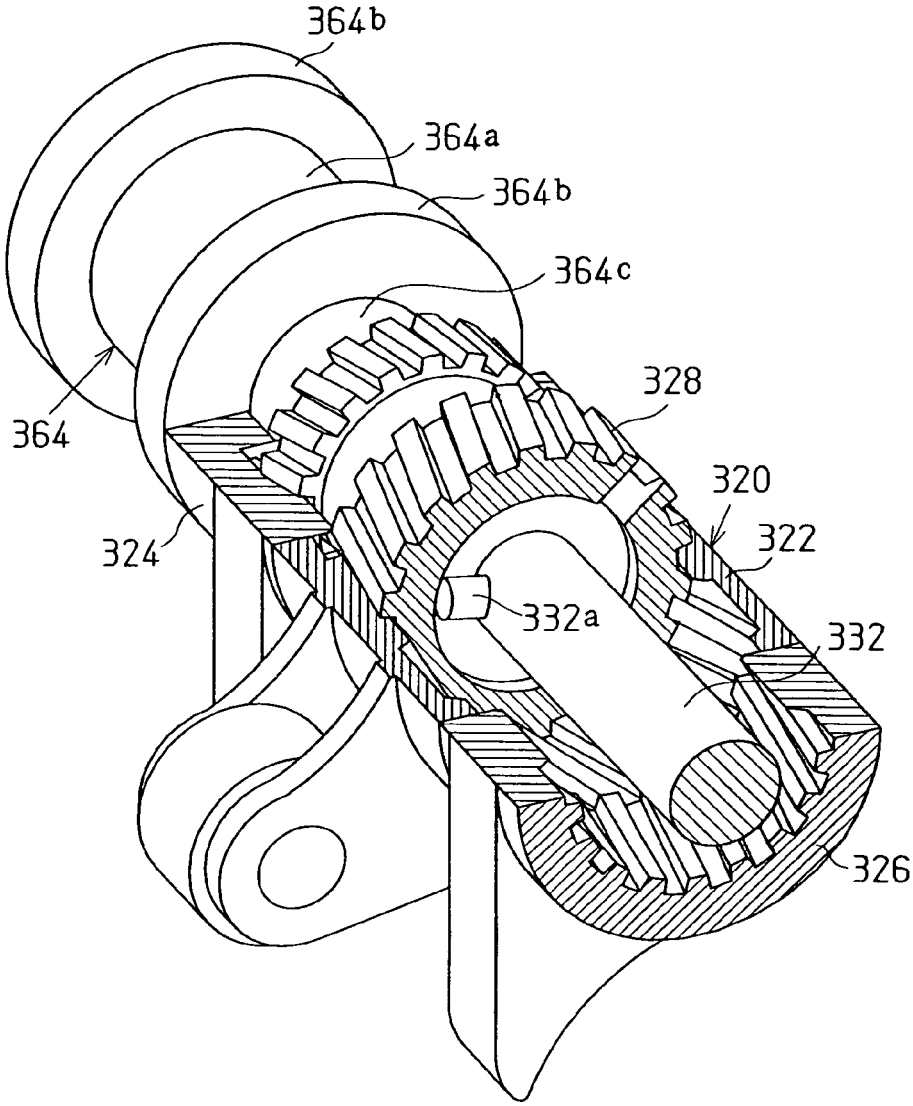

Referring to FIG. 24, a control pin 332*a*, which is fixed to the control shaft 332, is engaged with a slider gear 328. Movement of the control shaft 332 moves the slider gear 328 in the axial direction. The omission of a rocker shaft that would extend through the entire variable valve lift mechanism 320 reduces the diameter of each variable valve lift mechanism 320.

Figure 25:
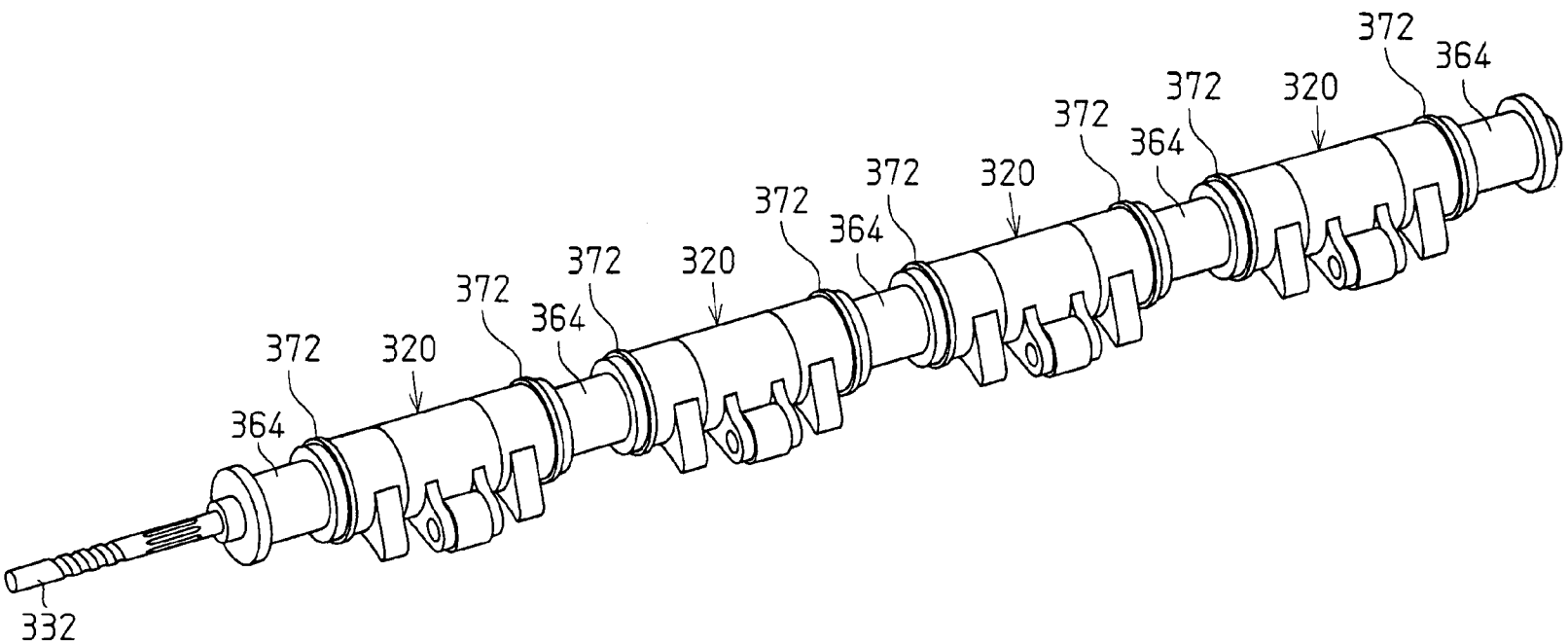
FIG. 25 is a perspective view showing the collars fastened to the control shaft and the variable valve lift mechanisms.

In the shaft assembly shown in FIG. 25, shim plates 372 are arranged between the collars 364 and the rocking cams 324 and 326. As shown in FIG. 20, the shaft assembly is mounted on the cam carrier 350. The distance between the two flanges 364*b* in each collar 364 is substantially the same as the thicknesses of a front wall 354 and the bearings 362. When the shaft assembly is arranged as shown in the state of FIG. 20, the front wall 354 and the bearings 362 support the collars 364 in a rotatable manner. The front wall 354 and the bearings 362 are held between the two flanges 364*b* of the corresponding collars 364. This prevents each collar 364 from being moved in the axial direction and determines the position of each variable valve lift mechanism 320 (input shaft 322, and rocking cams 324 and 326) in the axial direction.

In the second embodiment, the control shaft 332 functions as a shaft. The pivot shaft portions 364*c* formed on the ends of the sleeves 364*a* function to position the variable valve lift mechanisms 320.

The second embodiment has the advantages described below.

The pivot shaft portions 364*c* are formed on opposite ends of each collar 364. The pivot shaft portions 354*c* pivotally support the adjacent variable valve lift mechanism 320 and function as a pivot shaft of the variable valve lift mechanisms 320. This eliminates the need for a rocker shaft that extends through the variable valve lift mechanisms 320 and reduces the diameter of the variable valve lift mechanisms 320.

Figure 26:
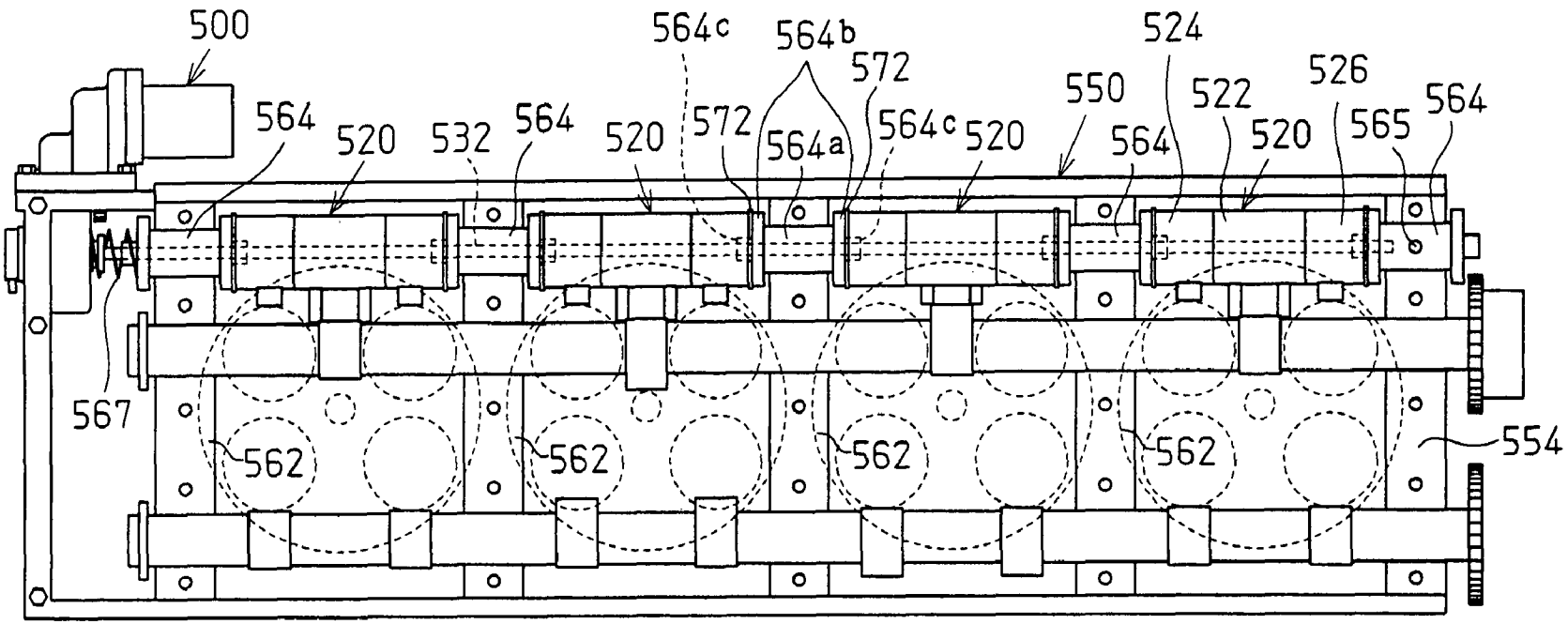
FIG. 26 is a plan view showing a cam carrier according to a third embodiment of the present invention.

A third embodiment of the present invention will now be discussed with reference to FIG. 26. FIG. 26 shows a cam carrier 550 from which cam caps are removed. The third embodiment employs collars 564 that are similar to those of the second embodiment. However, the distance between two flanges 564*b* in each collar 564 is greater than the thicknesses of a front wall 554 and bearings 562 of the cam carrier 550. This enables movement of the collars 564 in the axial direction with respect to the front wall 554 and the bearings 562.

Each variable valve lift mechanism 520 is rotatably supported by pivot shaft portions 564*c* of the adjacent collar 564 without the use of a rocker shaft. The collar 564 located farthest from the slide actuator 500 is fixed to the front wall 554 by a pin 565 and does not move in the axial direction. The collar 564 located closest to the slide actuator 500 is pushed toward the corresponding variable valve lift mechanism 520 by a spring 567. This keeps the collars 564 in a state directly contacting the variable valve lift mechanisms 520 or in a state indirectly contacting the variable valve lift mechanisms 520 by means of shim plates 572.

In the third embodiment, the cylinder block, the cylinder head, and the cam carrier 550 are formed from an aluminum alloy material. The variable valve lift mechanisms 520, the collars 564, and the shim plates 572 are formed from a steel material.

The control shaft 532 functions as a shaft. The flanges 564*b* and pivot shaft portions 564*c* formed on the ends of the sleeves 564*a* function to position the variable valve lift mechanisms 520.

The third embodiment has the advantages described below.

The flanges 564*b* of the collars 564 directly contact the end faces of the rocking cams 524 and 526 or indirectly contacts the end faces of the rocking cams 524 and 526 by means of the shim plates 572. This contact determines the positions of the variable valve lift mechanisms 520 in the axial direction. The flanges 564*b* are spaced with a clearance from the adjacent bearings 562 and cam caps. The positional relationship of the variable valve lift mechanisms 520 is affected only by the coefficient of thermal expansion of the collars 564, the input sleeves 522, and the rocking cams 524 and 526. However, the collars 564, the input sleeves 522, and the rocking cams 524 and 526 are formed from a steel material having a coefficient of thermal expansion that is the same or approximate to that of the material the control shaft 532 is formed from. Accordingly, even if temperature changes affect the collars 564, the input sleeves 522, and the rocking cams 524 and 526, the change in the positions of the slider gears in the variable valve lift mechanisms 520, which is determined by the control shaft 532, is substantially the same as the change in the positions of the input sleeve 522 and the rocking cams 524 and 526. Thus, the intake valves 12 have substantially the same lift amount in all of the cylinders. Since temperature changes do not cause differences between cylinders in the lift amount of the intake valves 12, the accuracy of lift amount adjustment is improved.

The pivot shaft portions 564*c* are formed on the two ends of each collar 564. The pivot shaft portions 564*c* rotatably support the adjacent variable valve lift mechanisms 520. Since the pivot shaft portions 564*c* function as pivot shafts of the variable valve lift mechanisms 520, the diameter of the variable valve lift mechanisms 520 is reduced.

It should be apparent to those skilled in the art that the present invention may be embodied in many other specific forms without departing from the spirit or scope of the invention. Particularly, it should be understood that the present invention may be embodied in the following forms.

In each of the above embodiments, the variable valve lift mechanisms and the camshafts may be directly mounted on the cylinder head without using a cam carrier.

The engine is not limited to a gasoline engine and may be any type of engine such as a diesel engine. Further, the engine is not limited to an engine used to drive vehicles and may be an engine used for other applications. In addition to lift amount adjustment of intake valves, the present invention may be applied to lift amount adjustment of exhaust valves or lift amount adjustment of both intake and exhaust valves.

In each of the above embodiments, the collars restrict movement of the variable valve lift mechanisms in the axial direction. When using a hollow shaft (rocker shaft) covering the control shaft as in the first embodiment, positioning members such as pins may be arranged on the rocker shaft. The positioning members may restrict movement of the variable valve lift mechanisms in the axial direction. This fixes the positional relationship of the variable valve lift mechanisms with respect to the rocker shaft. Thus, the distance between the bearings arranged on the cam carrier or cylinder head does not affect the positional relationship between the variable valve lift mechanisms.

Accordingly, even if the cylinder head or cam carrier is formed from a material other than steel, such as a light alloy, to reduce weight, a variable valve actuation mechanism may be formed from a material selected in accordance with the strength requirements. Further, even if a temperature change occurs, the valve lift adjustment amount is prevented from differing between cylinders. This improves the accuracy for adjusting the valve lift amount.

The present examples and embodiments are to be considered as illustrative and not restrictive, and the invention is not to be limited to the details given herein, but may be modified within the scope and equivalence of the appended claims.

What is claimed is:

1. A variable valve actuation mechanism for use in a multiple cylinder engine, the variable valve actuation mechanism comprising:

a plurality of variable valve lift mechanisms arranged in association with the cylinders of the engine to adjust the lift amount of respective valves of the cylinders, each variable valve lift mechanism including an end face;

a control shaft extending through the variable valve lift mechanisms in an axial direction;

an actuator for moving the control shaft in the axial direction and driving the variable valve lift mechanisms;

a hollow shaft receiving the control shaft; and a plurality of collars fastened to the hollow shaft and arranged alternately with the variable valve lift mechanisms for determining the positions of the variable valve lift mechanisms with respect to one another in the axial direction, each collar including;

a sleeve extending in the axial direction; and end portions formed integrally with the sleeve, at least one of the end portions directly or indirectly contacting the end face of an adjacent one of the variable valve lift mechanisms a plurality of supports for respectively supporting the collars, wherein each collar is supported by the corresponding support such that a clearance is formed between the end face of an adjacent one of the variable valve lift mechanisms and the corresponding support, the control shaft and the support holding the collar such as to restrict the sleeve from becoming eccentric while enabling movement of the collar in the axial direction.

2. The variable valve actuation mechanism according to claim 1, wherein each of the variable valve lift mechanisms includes:

an input portion for receiving drive force of a cam, the input portion having a first helical spline;

an output portion for outputting drive force to a valve, the output portion having a second helical spline; and a slider gear, extending between the input portion and the output portion, for mediating the transmission of drive formed from the input portion to the output portion, the slider gear including:

an input helical spline for meshing with the first helical spline; and an output helical spline for meshing with the second helical spline, wherein the input helical spline and the output helical spline extend in different helical angles, and the control shaft moves the slider gear in the axial direction of the control shaft to rotate the input and output helical splines relative to the input and output portions.

3. The variable valve actuation mechanism according to claim 1, wherein at least one of the end portions engages the end face of an adjacent one of the variable valve lift mechanisms and includes a shaft projection functioning as part of a pivot shaft of the variable valve lift mechanisms.

4. The variable valve actuation mechanism according to claim 3, wherein each of the variable valve lift mechanisms includes:

an input portion for receiving drive force of a cam, the input portion having a first helical spline;

an output portion for outputting drive force to a valve, the output portion having a second helical spline; and a slider gear, extending between the input portion and the output portion, for mediating the transmission of drive formed from the input portion to the output portion, the slider gear including:

an input helical spline for meshing with the first helical spline; and an output helical spline for mashing with the second helical spline, wherein the input helical spline and the output helical spline extend in different helical angles, and the control shaft moves the slider gear in the axial direction of the control shaft to rotate the input and output helical splines relative to the input and output portions.

5. The variable valve actuation mechanism according to claim 1, wherein at least one of the end portions directly or indirectly contacts the end face of an adjacent one of the variable valve lift mechanisms to determine the positional relationship between the variable valve lift mechanisms in the axial direction, and includes a flange for determining the position of the corresponding variable valve lift mechanism with respect to the adjacent variable valve lift mechanism in the axial direction and a shaft projection for engaging the end face of the one of the variable valve lift mechanisms to function as part of a pivot shaft of the variable valve lift mechanism.

6. The variable valve actuation mechanism according to claim 5, wherein each of the variable valve lift mechanisms includes:

an input portion for receiving drive force of a cam, the input portion having a first helical spline;

an output portion for outputting drive force to a valve, the output portion having a second helical spline; and a slider gear, extending between the input portion and the output portion, for mediating the transmission of drive formed from the input portion to the output portion, the slider gear including:

an input helical spline for meshing with the first helical spline; and an output helical spline for meshing with the second helical spline, wherein the input helical spline and the output helical spline extend in different helical angles, and the control shaft moves the slider gear in the axial direction of the control shaft to rotate the input and output helical splines relative to the input and output portions.

7. The variable valve actuation mechanism according to claim 1, comprising:

the hollow shaft being formed from a metal material having a first coefficient of thermal expansion, wherein the plurality of collars fastened to the hollow shaft are arranged alternately with the variable valve lift mechanisms for determining the positions of the variable valve lift mechanisms with respect to one another in the axial direction; and wherein the sleeve and the at least one end portion are formed from a material having a coefficient of thermal expansion that is equal to or approximate to the first coefficient of thermal expansion.

8. The variable valve actuation mechanism according to claim 7, wherein each of the variable valve lift mechanisms includes:

an input portion for receiving drive force of a cam, the input portion having a first helical spline;

an output portion for outputting drive force to a valve, the output portion having a second helical spline; and a slider gear, extending between the input portion and the output portion, for mediating the transmission of drive formed from the input portion to the output portion, the slider gear including:

an input helical spline for meshing with the first helical spline; and an output helical spline for meshing with the second helical spline, wherein the input helical spline and the output helical spline extend in different helical angles, and the control shaft moves the slider gear in the axial direction of the control shaft to rotate the input and output helical splines relative to the input and output portions.

9. The variable valve actuation mechanism according to claim 1, comprising:

a plurality of supports for supporting the variable valve lift mechanisms via the hollow shaft; wherein:

the variable valve lift mechanisms are secured to the hollow shaft in a state in which movement in the axial direction is restricted in order to determine the positions of the variable valve lift mechanisms with respect to one another in the axial direction.

10. The variable valve actuation mechanism according to claim 9, wherein:

the plurality of collars are fastened to the hollow shaft in a manner unmovable in the axial direction and arranged alternately with the variable valve lift mechanisms for determining the positions of the variable valve lift mechanisms with respect to one another in the axial direction; and the sleeve of each collar is arranged between the hollow shaft and a corresponding one of the supports so that at least one of the end portions directly or indirectly contacts or engages the end face of one of the variable valve lift mechanisms to determine the positions of the variable valve lift mechanisms.

11. The variable valve actuation mechanism according to claim 1, wherein:

the plurality of collars are fastened to the hollow shaft in a manner unmovable in the axial direction of the hollow shaft and unrotatable about the hollow shaft.

12. The variable valve actuation mechanism according to claim 1, wherein:

each of the plurality of collars are fastened to the hollow shaft via a fastening pin.

13. A variable valve actuation mechanism for use in a multiple cylinder engine, the variable valve actuation mechanism comprising:

a plurality of variable valve lift mechanisms respectively arranged in association with the cylinders of the engine, each variable valve lift mechanism having an end face;

a control shaft extending through the variable valve lift mechanisms in an axial direction;

a hollow shaft for receiving the control shaft, the hollow shaft formed from a metal material having a first coefficient of thermal expansion;

an actuator for moving the control shaft in the axial direction and driving the variable valve lift mechanisms; and a plurality of collars fastened to the hollow shaft and arranged alternately with the variable valve lift mechanisms for determining the positions of the variable valve lift mechanisms with respect to one another in the axial direction;

a plurality of supports for respectively supporting the collars, each collar including:

a sleeve extending in the axial direction; and end portions formed integrally with the sleeve, the sleeve and the at least one end portion being formed from a material having a coefficient of thermal expansion that is equal to or approximate to the first coefficient of thermal expansion;

wherein each collar is supported by the corresponding support such that a clearance is formed between the end face of an adjacent one of the variable valve lift mechanisms and the corresponding support, the control shaft and the support holding the collar such as to restrict the sleeve from becoming eccentric while enabling movement of the collar in the axial direction.

14. The variable valve actuation mechanism according to claim 13, wherein each of the variable valve lift mechanisms includes:

an input portion for receiving drive force of a cam, the input portion having a first helical spline;

an output portion for outputting drive force to a valve, the output portion having a second helical spline; and a slider gear, extending between the input portion and the output portion, for mediating the transmission of drive formed from the input portion to the output portion, the slider gear including:

an input helical spline for meshing with the first helical spline; and an output helical spline for meshing with the second helical spline, wherein the input helical spline and the output helical spline extend in different helical angles, and the control shaft moves the slider gear in the axial direction of the control shaft to rotate the input and output helical splines relative to the input and output portions.

15. A variable valve actuation mechanism for use in a multiple cylinder engine, the variable valve actuation mechanism comprising:

a control shaft extending across cylinders of the engine and supported by a plurality of supports arranged on the engine;

a plurality of variable valve lift mechanisms supported by the control shaft and arranged in association with the cylinders of the engine, wherein the control shaft is moved in an axial direction to drive the plurality of variable valve lift mechanisms; and a collar including a sleeve, which is arranged between one of the supports and the control shaft and is supported by the one of the supports, and a variable valve lift mechanism positioning portion, which is formed on an end of the sleeve so as to directly or indirectly contact an end of one of the variable valve lift mechanisms, wherein the collar is arranged between one of the supports and the control shaft to regulate positions of one of the variable valve lift mechanisms corresponding to one of the cylinders and an adjacent one of the variable valve lift mechanisms corresponding to an adjacent one of the cylinders in the axial direction, and wherein the collar is supported such that a clearance is formed between the end of the one of the variable lift mechanisms and the one of the supports.

* * * * *